US010328722B2

(12) United States Patent
Katoh et al.

(10) Patent No.: US 10,328,722 B2
(45) Date of Patent: Jun. 25, 2019

(54) IMAGE FORMING METHOD AND IMAGE FORMING APPARATUS

(71) Applicants: Keita Katoh, Superior, CO (US); Hiroshi Gotou, Kanagawa (JP); Masayasu Nonogaki, Shizuoka (JP); Kazuhiko Umemura, Kanagawa (JP); Masaki Kudo, Kanagawa (JP)

(72) Inventors: Keita Katoh, Superior, CO (US); Hiroshi Gotou, Kanagawa (JP); Masayasu Nonogaki, Shizuoka (JP); Kazuhiko Umemura, Kanagawa (JP); Masaki Kudo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/983,620

(22) Filed: May 18, 2018

(65) Prior Publication Data

US 2018/0339525 A1 Nov. 29, 2018

(30) Foreign Application Priority Data

May 23, 2017 (JP) ..... 2017-101865
Feb. 27, 2018 (JP) ..... 2018-032767

(51) Int. Cl.
*B41J 11/00* (2006.01)
*B41J 15/16* (2006.01)
*B41M 7/00* (2006.01)

(52) U.S. Cl.
CPC ..... *B41J 11/002* (2013.01); *B41J 15/16* (2013.01); *B41M 7/00* (2013.01); *B41M 7/009* (2013.01)

(58) Field of Classification Search
CPC ..... B41J 11/002; B41J 15/16
See application file for complete search history.

(56) References Cited

U.S. PATENT DOCUMENTS 8,764,178 B2 * 7/2014 Tamanuki ..... B41J 2/165 347/100
9,243,158 B2 * 1/2016 Toda ..... C09D 11/36
(Continued)

FOREIGN PATENT DOCUMENTS

JP 2000-053897 2/2000
JP 2001-139849 5/2001
(Continued)

OTHER PUBLICATIONS

U.S. Appl. No. 15/794,068, filed Oct. 26, 2017, Masahiko Ishikawa, et al.
(Continued)

*Primary Examiner* — Lamson D Nguyen
(74) *Attorney, Agent, or Firm* — Oblon, McClelland, Maier & Neustadt, L.L.P.

(57) ABSTRACT

An image forming method is provided. The method includes the steps of: applying a liquid composition, comprising a pigment, water, a resin, and an organic solvent, to a recording medium having water-absorptivity to form an image thereon; and winding up the recording medium in a roll form after the applying, wherein the following formulae are satisfied:

$$1.00\times10^{-3}\leq A\leq4.00\times10^{-1}$$

$$0.010\leq B/A\leq0.100$$

where B (mg/cm$^2$) represents an amount of the organic solvent contained in the image after the winding and A (mg/cm$^2$) represents a total amount of the organic solvent contained in the image and the recording medium after the winding.

17 Claims, 2 Drawing Sheets

(56) References Cited

U.S. PATENT DOCUMENTS

| | | | |
|---|---|---|---|
| 2014/0002539 | A1 | 1/2014 | Goto et al. |
| 2015/0376425 | A1 | 12/2015 | Hakiri et al. |
| 2016/0075892 | A1 | 3/2016 | Harada et al. |
| 2016/0130452 | A1 | 5/2016 | Katoh et al. |
| 2016/0222234 | A1 | 8/2016 | Matsuyama et al. |
| 2016/0333208 | A1 | 11/2016 | Gotou et al. |
| 2016/0376455 | A1 | 12/2016 | Katoh et al. |
| 2017/0009092 | A1 | 1/2017 | Gotou et al. |
| 2017/0022381 | A1 | 1/2017 | Takamura et al. |
| 2017/0107389 | A1 | 4/2017 | Umemura et al. |
| 2017/0121543 | A1 | 5/2017 | Sakaguchi et al. |
| 2017/0130081 | A1 | 5/2017 | Toyama et al. |
| 2017/0136785 | A1 | 5/2017 | Katoh |
| 2017/0182770 | A1 | 6/2017 | Gotou |
| 2017/0247556 | A1 | 8/2017 | Yokohama et al. |
| 2017/0267888 | A1 | 9/2017 | Yokohama et al. |
| 2018/0030292 | A1 | 2/2018 | Gotou et al. |
| 2018/0094149 | A1 | 4/2018 | Katoh |
| 2018/0105711 | A1 | 4/2018 | Katoh et al. |

FOREIGN PATENT DOCUMENTS

| | | |
|---|---|---|
| JP | 2009-226907 | 10/2009 |
| JP | 2010-208299 | 9/2010 |
| JP | 2012-207202 | 10/2012 |
| JP | 2013-060565 | 4/2013 |

OTHER PUBLICATIONS

U.S. Appl. No. 15/822,336, filed Nov. 27, 2017, Hiromi Sakaguchi, et al.

* cited by examiner

IMAGE FORMING METHOD AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2017-101865 and 2018-032767, filed on May 23, 2017 and Feb. 27, 2018, respectively, in the Japan Patent Office, the entire disclosure of each of which is hereby incorporated by reference herein.

BACKGROUND

Technical Field

The present disclosure relates to an image forming method and an image forming apparatus.

Description of the Related Art

Inkjet recording methods have advantages such that the process is simple and full colorization is easy in comparison with other recording methods. Therefore, high-resolution images can be obtained by an inkjet recording device having a simple configuration. For this reason, inkjet recording methods are widely diffusing from home use to office use, commercial printing, and industrial printing. In the fields of commercial printing and industrial printing, water-absorptive recording media, such as plain paper, coated paper, and art paper, are used as recording media and required to exhibit high image density and gloss value.

In such inkjet recording methods, water-based inks have been used. In particular, dye inks containing a water-soluble dye have been conventionally used, and pigment inks containing a water-insoluble pigment are also used these days for their excellent waterfastness and light resistance. In a case in which an image is formed with a water-based ink on a water-absorptive recording medium, water permeated into the recording medium may deform the recording medium and cause wrinkles (this phenomenon is hereinafter referred to as "cockling").

SUMMARY

In accordance with some embodiments of the present invention, an image forming method is provided. The method includes the steps of: applying a liquid composition, comprising a pigment, water, a resin, and an organic solvent, to a recording medium having water-absorptivity to form an image thereon; and winding up the recording medium in a roll form after the applying, wherein the following formulae are satisfied:

$$1.00\times10^{-3}\leq A\leq4.00\times10^{-1}$$

$$0.010\leq B/A\leq0.100$$

where B (mg/cm$^2$) represents an amount of the organic solvent contained in the image after the winding and A (mg/cm$^2$) represents a total amount of the organic solvent contained in the image and the recording medium after the winding.

In accordance with some embodiments of the present invention, another image forming method is also provided. The method includes the steps of: (a) applying a liquid composition, comprising a pigment, water, a resin, and an organic solvent, to a recording medium having water-absorptivity to form an image thereon; and (b) applying a pressure of from $1.00\times10^{-3}$ to $1.00\times10$ kgf/cm$^2$ to the recording medium after the step (a), wherein the following formulae are satisfied:

$$1.00\times10^{-3}\leq A\leq4.00\times10^{-1}$$

$$0.010\leq B/A\leq0.100$$

where B (mg/cm$^2$) represents an amount of the organic solvent contained in the image after the step (b) and A (mg/cm$^2$) represents a total amount of the organic solvent contained in the image and the recording medium after the step (b).

In accordance with some embodiments of the present invention, an image forming apparatus is provided. The image forming apparatus includes: a storage storing a liquid composition comprising a pigment, water, a resin, and an organic solvent; a recording medium storage storing a recording medium having water-absorptivity; an applying device configured to apply the liquid composition to the recording medium to form an image thereon; and a winder configured to wind up the recording medium having the image thereon, wherein the following formulae are satisfied:

$$1.00\times10^{-3}\leq A\leq4.00\times10^{-1}$$

$$0.010\leq B/A\leq0.100$$

where B (mg/cm$^2$) represents an amount of the organic solvent contained in the image on the recording medium wound up by the winder and A (mg/cm$^2$) represents a total amount of the organic solvent contained in the image and the recording medium wound up by the winder.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
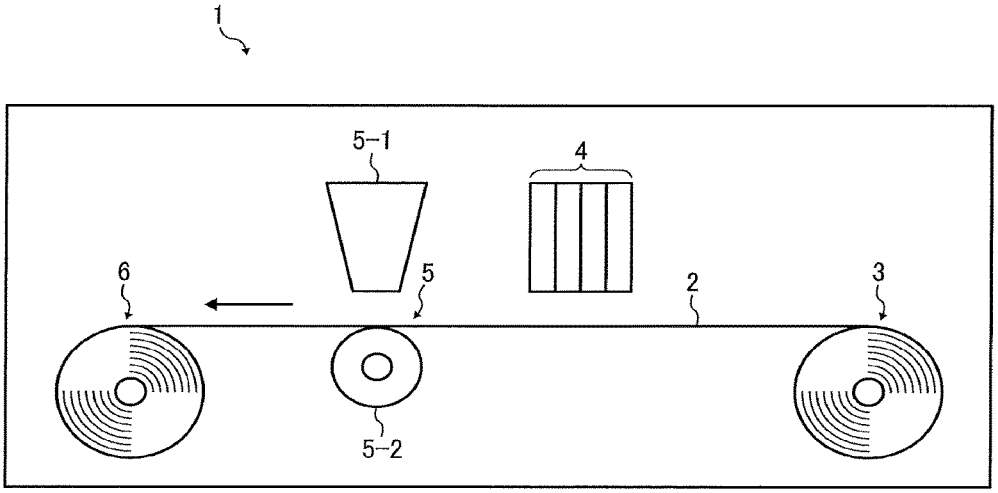
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In a case in which an image is formed with a liquid composition containing a pigment on a water-absorptive recording medium such as plain paper, coated paper, and art paper, wrinkles may appear when the liquid composition permeates the recording medium in large amount. By contrast, when the liquid composition permeates the recording medium in small amount, the image portion may be lost due to transfer or abrasion. There has been a problem that conventional image forming methods cannot suppress the occurrence of cockling or loss of image portion.

In accordance with some embodiments of the present invention, an image forming method is provided that forms an image with a liquid composition containing a pigment on a water-absorptive recording medium while suppressing the occurrence of cockling of the recording medium and loss of image portion.

Image Forming Method

An image forming method according to an embodiment of the present invention includes the processes of: applying a liquid composition, comprising a pigment, water, a resin, and an organic solvent, to a recording medium having water-absorptivity to form an image thereon; and winding up the recording medium in a roll form after the applying process, and the following formulae are satisfied: $1.00\times10^{-3}\leq A\leq4.00\times10^{-1}$ and $0.010\leq B/A\leq0.100$, where B (mg/cm$^2$) represents an amount of the organic solvent contained in the image after the applying process and A (mg/cm$^2$) represents a total amount of the organic solvent contained in the image and the recording medium after the applying process.

This image forming method according to an embodiment of the present invention forms an image on a water-absorptive recording medium with a liquid composition containing a pigment while suppressing the occurrence of cockling of the recording medium, reduction in image density and gloss value, and loss of image portion.

In the winding process, preferably, a pressure of from $1.00\times10^{-3}$ to $1.00\times10$ kgf/cm$^2$, more preferably from $5.00\times10^{-1}$ to $1.00\times10$ kgf/cm$^2$ is applied to the recording medium to which the liquid composition is applied.

Preferably, a total amount of the pigment and the resin contained in the image formed on the recording medium per unit area is from 20 to 200 μg/cm$^2$.

Preferably, the resin has a glass transition temperature of from 50° C. to 140° C.

In the winding process, preferably, the recording medium has a temperature of from 30° C. to 60° C. under the pressure.

Preferably, the image forming method further includes the process of drying the recording medium to which the liquid composition is applied by applying heated wind having a temperature of 120° C. or higher to the recording medium.

Preferably, the liquid composition has a viscosity of from 6.0 to 10.0 mPa·s at 25° C.

Preferably, $\eta1/\eta0$ is in the range of from 5.0 to 30.0, where $\eta0$ represents a viscosity at 25° C. of the liquid composition and $\eta1$ represents a viscosity at 25° C. of the liquid composition evaporated under atmospheric pressure at 50° C. until a mass ratio of the liquid composition after evaporation to the liquid composition before evaporation becomes 60%.

Preferably, the water-absorptive recording medium has a basis weight of from 75 to 190 g/m$^2$.

Preferably, the liquid composition further comprises isopropylene glycol.

An image forming method according to another embodiment of the present invention includes the processes of: (a) applying a liquid composition, comprising a pigment, water, a resin, and an organic solvent to a recording medium having water-absorptivity to form an image thereon; and (b) applying a pressure of from $1.00\times10^{-3}$ to $1.00\times10$ kgf/cm$^2$ to the recording medium after the process (a), and the following formulae are satisfied: $1.00\times10^{-3}\leq A\leq4.00\times10^{-1}$ and $0.010\leq B/A\leq0.100$, where B (mg/cm$^2$) represents an amount of the organic solvent contained in the image after the process (b) and A (mg/cm$^2$) represents a total amount of the organic solvent contained in the image and the recording medium after the process (b).

In the process (b), preferably, a pressure of from $1.00\times10^{-3}$ to $1.00\times10$ kgf/cm$^2$, more preferably from $5.00\times10^{-1}$ to $1.00\times10$ kgf/cm$^2$ is applied to the recording medium to which the liquid composition is applied Preferably, the process (b) further includes the process of: winding up the recording medium to apply the pressure thereto; stacking the recording medium to apply a weight of the recording medium as the pressure thereto; or pressing the recording medium with a pressing roller to apply the pressure thereto.

Preferably, a total amount of the pigment and the resin contained in the image formed on the recording medium per unit area is from 20 to 200 μg/cm$^2$.

Preferably, the resin has a glass transition temperature of from 50° C. to 140° C.

In the process (b), preferably, the recording medium has a temperature of from 30° C. to 60° C. under the pressure.

Preferably, the image forming method further includes the process of drying the recording medium to which the liquid composition is applied by applying heated wind having a temperature of 120° C. or higher to the recording medium.

Preferably, the liquid composition has a viscosity of from 6.0 to 10.0 mPa·s at 25° C.

Preferably, $\eta1/\eta0$ is in the range of from 5.0 to 30.0, where $\eta0$ represents a viscosity at 25° C. of the liquid composition and $\eta1$ represents a viscosity at 25° C. of the liquid composition evaporated under atmospheric pressure at 50° C. until a mass ratio of the liquid composition after evaporation to the liquid composition before evaporation becomes 60%.

Preferably, the water-absorptive recording medium has a basis weight of from 75 to 190 g/m$^2$.

Preferably, the liquid composition further comprises isopropylene glycol.

Liquid Composition

The liquid composition used in the above-described image forming method contains a pigment, water, a resin, and an organic solvent, and optionally other components.

Pigment

Usable pigments include both inorganic pigments and organic pigments. One type of pigment can be used alone, or two or more types of pigments can be used in combination. Mixed crystals can also be used as pigments.

Usable pigments include black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, barium yellow, cadmium red, chrome yellow, and carbon black produced by a known method, such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (e.g., basic dye chelate, acid dye chelate), nitro pigments, nitroso pigments, and aniline black. Among these pigments, those having good affinity for solvents are preferable. In addition, resin hollow particles and inorganic hollow particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C.I. Pigment Violet 1 (rhodamine lake), 3, 5:1, 16, 19, 23, and 38; C.I. Pigment Blue 1, 2, 15 (phthalocyanine blue), 15:1, 15:2, 15:3, 15:4 (phthalocyanine blue), 16, 17:1, 56, 60, and 63; and C.I. Pigment Green 1, 4, 7, 8, 10, 17, 18, and 36.

Dispersion state of the pigment is not particularly limited so long as the pigment is dispersed in water by means of, for example, use of a surfactant or a resin, resin coating of the pigment, or self-dispersion of the pigment achieved by introduction of a hydrophilic group to the surface of the pigment. In particular, use of a resin, resin coating of the pigment, and self-dispersion are preferable; and use of a resin is most preferable.

Specific examples of the hydrophilic group include, but are not limited to, —COOM, —$SO_3M$, —$PO_3HM$, —$PO_3M_2$, —$CONM_2$, —$SO_3NM_2$, —NH—$C_6H_4$—COOM, —NH—$C_6H_4$—$SO_3M$, —NH—$C_6H_4$—$PO_3HM$, —NH—$C_6H_4$—$PO_3M_2$, —NH—$C_6H_4$—$CONM_2$, and —NH—$C_6H_4$—$SO_3NM_2$, where M representing a counter ion.

Preferably, the counter ion M is a quaternary ammonium ion. A reason for this is considered that, even when the liquid composition has transited from a water-rich state to an organic-solvent-rich state by evaporation of moisture, the hydrophilic group containing a quaternary ammonium ion can keep pigment dispersion stable. Thus, temporal storage stability of the liquid composition is improved and a viscosity increase of the liquid composition is suppressed.

Specific examples of the quaternary ammonium ion include, but are not limited to, tetramethylammonium ion, tetraethylammonium ion, tetrapropylammonium ion, tetrabutylammonium ion, tetrapentylammonium ion, benzyltrimethylammonium ion, benzyltriethylammonium ion, and tetrahexylammonium ion. Among these, tetraethylammonium ion, tetrabutylammonium ion, and benzyltrimethylammonium ion are preferable; and tetrabutylammonium ion is most preferable.

An emulsion of fine polymer particles containing a pigment is one preferred example of the resin-coated pigment. In the emulsion of fine polymer particles containing a pigment, the pigment may be either encapsulated in the fine polymer particles or adsorbed to the surfaces of the fine polymer particles. Not all the pigment granules need to be encapsulated in or adsorbed to the fine polymer particles and a part of the pigment granules can be solely dispersed in the emulsion. Examples of the polymer used for the fine polymer particles include, but are not limited to, vinyl polymers, polyester polymers, and polyurethane polymers. Among these polymers, vinyl polymers and polyester polymers are preferable. Specific examples of such polymer particles include those disclosed in JP-2000-53897-A and JP-2001-139849-A.

Additionally, typical organic pigments, and composite pigments in which inorganic pigment particles are coated with an organic pigment or carbon black are usable. Such a composite pigment may be prepared by a deposition method that deposits an organic pigment in the presence of inorganic pigment particles or a mechanochemical method that mechanically mixes and grinds an inorganic pigment and an organic pigment. To improve adhesion between the inorganic pigment and the organic pigment, an organosilane compound layer may be formed therebetween from a polysiloxane and/or an alkylsilane.

In the composite pigment, the mass ratio of the inorganic pigment particles to the colorant (i.e., an organic pigment or carbon black) is preferably from 3/1 to 1/3, and more preferably from 3/2 to 1/2. When the amount of the colorant is too small, color developing property and coloring power may deteriorate. When the amount of the colorant is too large, transparency and color tone may deteriorate.

Specific preferred examples of the composite pigments include, but are not limited to, silica/carbon black composite pigments, silica/phthalocyanine PB 15:3 composite pigments, silica/disazo yellow composite pigments, silica/quinacridone PR 122 composite pigments, all available from TODA KOGYO CORP., the primary average particle diameter of each of which is small.

In a case in which inorganic pigment particles having a primary particle diameter of 20 nm are coated with an organic pigment having a size of 2.5 nm, the primary particle diameter of the composite pigment becomes approximately 25 nm. If primary particles of the inorganic pigment particles can be dispersed with an appropriate dispersant, a liquid composition will be obtained as an ink in which very fine particles of the pigment are dispersed with a dispersion diameter of 25 nm. Not only the organic pigment present at the surface, but also the inorganic pigment present under the 2.5-nm thin layer of the organic pigment contributes to dispersion of the composite pigment. Therefore, the composite pigment is preferably dispersed with a dispersant agent which is capable of stably dispersing both the organic pigment and the inorganic pigment at the same time.

Preferably, the pigment has a BET specific surface area of about 10 to 1,500 $m^2/g$, more preferably about 20 to 600 $m^2/g$, and most preferably about 50 to 300 $m^2/g$. The specific surface area may be controlled by subjecting the pigment to a pulverization treatment, such as ball mill pulverization, jet mill pulverization, and ultrasonic treatment, to reduce the particle diameter of the pigment.

Preferably, the pigment has a volume average particle diameter (D50) of from 10 to 200 nm in the liquid composition. The content rate of the pigment in the liquid composition is preferably in the range of from 1% to 15% by mass, more preferably from 2% to 10% by mass, based on solid contents. When the content rate is 1% by mass or more, color developing power and image density improve. When the content rate is 15% by mass or less, thickening of the liquid composition is suppressed and discharge of the liquid composition is stabilized, which is preferred in terms of cost. In the present embodiment, a dye may be used in combination with the pigment for the purpose of adjusting color tone so long as fade resistance is not degraded.

Water

The water may be pure water such as ion-exchange water, ultrafiltration water, reverse osmosis water, and distilled water, or ultrapure water. Each type of these waters can be used alone or in combination with others.

Resin

Preferred examples of the resin include water-dispersible resins. A water-dispersible resin consists of a resin capable of being dispersed in water, and is discriminated from the above-described resin used for resin-coated pigments. Examples of the water-dispersible resin include either a self-dispersible resin having a hydrophilic group or a non-self-dispersible resin to which dispersibility has been imparted by a surfactant or another resin having a hydrophilic group. Water-dispersible resins having excellent film-forming property, that is, image forming property, as well as high water-repellent property, high water resistance, and high fade resistance, are advantageous for forming images having high waterfastness, high image density, and high color developing property. Specific examples of such water-dispersible resins include, but are not limited to, condensation-type synthetic resins, addition-type synthetic resins, and natural polymers. Each type of these resins can be used alone or in combination with others.

Specific examples of the condensation-type synthetic resins include, but are not limited to, polyester resin, polyurethane resin, polyepoxy resin, polyamide resin, polyether resin, polyacrylic or polymethacrylic resin, acrylic-silicone resin, and fluorine-based resin. Specific examples of the addition-type synthetic resins include, but are not limited to, polyolefin resin, polystyrene resin, polyvinyl alcohol resin, polyvinyl ester resin, polyacrylic acid resin, and unsaturated carboxylic acid resin. Specific examples of the natural polymers include, but are not limited to, celluloses, rosins, and natural rubbers. Among these, acrylic-silicone resin and fluorine-based resin are preferable.

Preferred examples of the resin further include: ionomers of polyester or polyurethane resin; and an emulsion of resin particles obtained by an emulsion polymerization or suspension polymerization of unsaturated monomers. The emulsion polymerization of unsaturated monomers may be performed by polymerizing unsaturated monomers in water containing a polymerization initiator, a surfactant, a chain transfer agent, a chelating agent, a pH adjuster, etc. This is an easy way of obtaining a water-dispersible resin and varying the resin composition in accordance with use purpose.

Preferably, the pH of the resin is in the range of from 4 to 12 because molecular chain cleavage phenomena, such as dispersion destruction and hydrolysis, may be caused under a strongly basic or acidic environment. More preferably, the pH of the resin is in the range of from 6 to 11, and most preferably from 7 to 10, for miscibility with water-dispersible pigments.

The volume average cumulative particle diameter (D50) of the resin particles correlates with the viscosity of the dispersion liquid. As the volume average cumulative particle diameter becomes smaller, the viscosity becomes larger if the composition and solid contents are the same. For preventing the liquid composition from thickening, preferably, the volume average cumulative particle diameter (D50) of the resin particles is 50 nm or more. Resin particles having a volume average cumulative particle diameter in excess of several tens of micrometers cannot be used, because they are larger than nozzle openings of an inkjet head. If large resin particles are present in the liquid composition, even if they are smaller than nozzle openings, dischargeability of the liquid composition will be degraded. Accordingly, preferably, the volume average cumulative particle diameter (D50) of the resin particles is 200 nm at most, more preferably 150 nm at most, so that dischargeability of the liquid composition becomes stable. The volume average cumulative particle diameter (D50) can be measured with a particle size distribution analyzer (NANOTRAC UPA-EX150 available from Nikkiso Co., Ltd.).

The resin having been discharged is formed into a film at normal temperature, so that the pigment is more reliably fixed on a surface of a recording medium. Therefore, preferably, the minimum film-forming temperature (MFT) of the resin is 30° C. or less. In addition, preferably, the glass transition temperature of the resin is in the range of from 50° C. to 140° C. When the glass transition temperature is 50° C. or more, image density increases. When the glass transition temperature is 140° C. or less, cockling is unlikely to occur and image quality improves.

Organic Solvent

There is no specific limitation on the type of the organic solvent. For example, water-soluble organic solvents are usable. Examples of water-soluble organic solvents include polyols, ethers (e.g., polyol alkyl ethers and polyol aryl ethers), nitrogen-containing heterocyclic compounds, amides, amines, and sulfur-containing compounds.

Specific examples of the water-soluble organic solvents include, hut are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propionamide, and 3-butoxy-N,N-dimethyl propionamide; amines such as monoethanolamine, diethanolamine, and triethylamine; sulfur-containing compounds such as dimethyl sulfoxide, sulfolane, and thiodiethanol; propylene carbonate; and ethylene carbonate. In particular, organic solvents having a boiling point of 250° C. or less are preferable, since they can function as a wetting agent while providing good drying property. In addition, 3-ethyl-3-hydroxymethyloxetane can also be used as the organic solvent.

In addition, polyol compounds having 8 or more carbon atoms and glycol ether compounds are also preferable. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

In particular, the polyol compounds having 8 or more carbon atoms and the glycol ether compounds, exemplified above, are capable of improving paper-permeability of the liquid composition, which is advantageous when paper is used as a recording medium.

Preferably, the content rate of the organic solvent in the liquid composition is in the range of from 10% to 60% by mass, more preferably from 20% to 60% by mass, for drying property and discharge reliability of the liquid composition.

Preferably, the liquid composition comprises isopropylene glycol as the organic solvent. When the liquid composition comprises isopropylene glycol as the organic solvent, blocking is unlikely to occur and image quality improves.

Other Components

Examples of the other components include, but are not limited to, surfactant, water-dispersible resin, defoamer, preservative, fungicide, pH adjuster, chelating agent, corrosion inhibitor, antioxidant, ultraviolet absorber, oxygen absorber, and photostabilizer.

Surfactant

Usable surfactants include silicone-based surfactants, fluorine-based surfactants, ampholytic surfactants, nonionic surfactants, and anionic surfactants.

The silicone-based surfactants have no specific limit and can be suitably selected to suit to a particular application. Preferred are silicone-based surfactants which are not decomposed even in a high pH environment. Specific examples thereof include, but are not limited to, side-chain-modified polydimethylsiloxane, both-end-modified polydimethylsiloxane, one-end-modified polydimethylsiloxane, and side-chain-both-end-modified polydimethylsiloxane. In particular, those having a polyoxyethylene group and/or a polyoxyethylene polyoxypropylene group as the modifying group are preferable because they demonstrate good characteristics as an aqueous surfactant. Specific examples of the silicone-based surfactants further include polyether-modified silicone-based surfactants, such as a dimethyl siloxane compound having a polyalkylene oxide structure unit on a side chain thereof which is bonded to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on its side chain. These compounds have weak foaming property, which is preferable. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block copolymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these surfactants can be used alone or in combination with others.

Specific examples of the silicone-based surfactants include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having polyoxyethylene group and/or polyoxyethylene polyoxypropylene group as the modifying groups are preferable since they exhibit good properties as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

Specific examples of the polyether-modified silicone-based surfactants include, but are not limited to, a compound represented by the following formula (S-1) that is a dimethylpolysiloxane having a polyalkylene oxide structure on its side chain bonded to Si atom.

Formula (S-1)

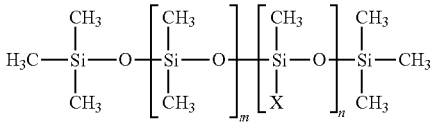

$X = -R(C_2H_4O)_a(C_3H_6O)_bR'$

In the formula (S-1), each of m, n, a, and b independently represents an integer, R represents an alkylene group, and R' represents an alkyl group.

Specific examples of commercially-available polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ-2163, and FZ-2164 (available from Dow Corning Toray Co., Ltd); BYK-33 and BYK-387 (available from BYK Japan KK); and TSF4440, TSF4452, and TSF4453 (available from Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate compounds, perfluoroalkyl ethylene oxide adducts, and polyoxyalkylene ether polymer compounds having a perfluoroalkyl ether group on its side chain. Among these fluorine-based surfactants, polyoxyalkylene ether polymer compounds having a perfluoroalkyl ether group on its side chain are preferable since foaming property thereof is small. More specifically, compounds represented by the following formula (F-1) and (F-2) are preferable.

$$CF_3CF_2(CF_2CF_2)_m—CH_2CH_2O(CH_2CH_2O)_nH \quad \text{Formula (F-1)}$$

In the formula (F-1), m is preferably an integer in the range of from 0 to 10, and n is preferably an integer in the range of from 0 to 40, to give water-solubility to the compound.

$$C_nF_{2n+1}—CH_2CH(OH)CH_2—O—(CH_2CH_2O)_a—Y \quad \text{Formula (F-2)}$$

In the formula (F-2), Y represents H, $C_nF_{2n+1}$ (where n represents an integer of from 1 to 6), $CH_2CH(OH)CH_2—C_nF_{2n+1}$ (where n represents an integer of from 4 to 6), or $C_pF_{2p+1}$ (where p represents an integer of from 1 to 19); and a represents an integer of from 4 to 14.

The fluorine-based surfactants are available either synthetically or commercially. Specific examples of commercially-available fluorine-based surfactants include, but are not limited to: SURFLON S-111, S-112, S-113, S-121, S-131, S-132, S-141, and S-145 (available from Asahi Glass Co., Ltd.); Fluorad™ FC-93, FC-95, FC-98, FC-129, FC-135, FC-170C, FC-430, and FC-431 (available from Sumitomo 3M Limited); MEGAFACE F-470, F-1405, and F-474 (available from DIC Corporation); Zonyl® TBS, FSP, FSA, FSN-100, FSN, FSO-100, FSO, FS-300, UR, CAPSTONE FS-30, FS-31, FS-3100, FS-34, and FS-35 (available from The Chemours Company); FT-110, FT-250, FT-251, FT-400S, FT-150, and FT-400SW (available from NEOS COMPANY LIMITED); PolyFox PF-136A, PF-156A, PF-151N, PF-154, and PF-159 (available from OMNOVA Solutions Inc.); and UNIDYNE™ DSN-403N (available from Daikin Industries, Ltd.). Among these, for improving text quality, in particular color developing property, paper permeability, paper wettability, and uniform dying property, FS-3100, FS-34, and FS-300 (available from The Chemours Company), FT-110, FT-250, FT-251, FT-400S, FT-150, and FT-400SW (available from NEOS COMPANY LIMITED), PolyFox PF-151N (available from OMNOVA Solutions Inc.), and UNIDYNE™ DSN-403N (available from Daikin Industries, Ltd.) are particularly preferred.

Preferably, the content rate of the surfactant in the liquid composition is from 0.001% to 5% by mass, more preferably from 0.5% to 3% by mass. When the content rate is from 0.001% to 5% by mass, permeability and wettability to plain paper and commercial printing paper improve and thus fixability improves.

Defoamer

Specific examples of the defoamer include, but are not limited to, silicone defoamers, polyether defoamers, and fatty acid ester defoamers. Each type of these defoamers can be used alone or in combination with others. Among these defoamers, silicone defoamers are preferable since they have excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

The pH adjuster is not limited to a specific material so long as pH of the liquid composition can be adjusted to from 4 to 12, preferably from 7 to 11, without adversely affecting the liquid composition. When the pH is from 4 to 12, inkjet heads and/or ink supply units may be dissolved out in large amounts, thereby causing alternation, leakage, and defective discharge of the liquid composition as an ink.

Specific examples of the pH adjuster include, but are not limited to, alcohol amines, alkali metal hydroxides, ammonium hydroxides, phosphonium hydroxides, and alkali metal carbonates.

Specific examples of the alcohol amines include, but are not limited to, diethanolamine, triethanolamine, and 2-amino-2-ethyl-1,3-propanediol. Specific examples of the alkali metal hydroxides include, but are not limited to, lithium hydroxide, sodium hydroxide, and potassium hydroxide.

Specific examples of the ammonium hydroxides include, but are not limited to, ammonium hydroxide and quaternary ammonium hydroxide. Specific examples of the phosphonium hydroxides include, but are not limited to, quaternary phosphonium hydroxide. Specific examples of the alkali metal carbonates include, but are not limited to, lithium carbonate, sodium carbonate, and potassium carbonate.

Antioxidant

Specific examples of the antioxidant include, but are not limited to, phenol-based antioxidants (including hindered-phenol-based antioxidants), amine-based antioxidants, sulfur-based antioxidants, and phosphor-based antioxidants.

Ultraviolet Absorber

Specific examples of the ultraviolet absorber include, but are not limited to, benzophenone-based ultraviolet absorbers, benzotriazole-based ultraviolet absorbers, salicylate-based ultraviolet absorbers, cyanoacrylate-based ultraviolet absorbers, and nickel-complex-salt-based ultraviolet absorbers.

Method for Manufacturing Liquid Composition

The liquid composition may be manufactured by dispersing or dissolving the pigment, resin, organic solvent, water, and other optional components, in an aqueous medium, while stir-mixing them if necessary. The stir-mixing may be performed by a sand mill, homogenizer, ball mill, paint shaker, ultrasonic disperser, stirrer equipped with stirring blades, magnetic stirrer, or high-speed disperser.

Viscosity of Liquid Composition

The viscosity of the liquid composition may be measured by a viscometer (e.g., RE-80L available from Toki Sangyo Co., Ltd.). Preferably, the liquid composition has a viscosity of from 6.0 to 10.0 mPa·s at 25° C. When the viscosity is 6.0 mPa·s or more, cockling is unlikely to occur and image quality improves. When the viscosity is 10.0 mPa·s or less, image density increases, blocking is unlikely to occur, and image quality improves.

Preferably, $\eta 1/\eta 0$ is in the range of from 5.0 to 30.0, where $\eta 0$ (mPa·s) represents a viscosity at 25° C. of the liquid composition and $\eta 1$ (mPa·s) represents a viscosity at 25° C. of the liquid composition evaporated under atmospheric pressure at 50° C. to have a mass 60% that of the initial mass of the liquid composition. When $\eta 1/\eta 0$ is 5.0 or more, image density improves. When $\eta 1/\eta 0$ is 30.0 or less, blocking is unlikely to occur and image quality improves. The mass of the liquid composition may be reduced to 60% the initial mass by, for example, putting 5.0 g of the liquid composition in a glass petri dish having a diameter of 30 mm and leaving it to stand for a certain period of time in a thermostatic chamber having a temperature of 50° C.

Water-Absorptive Recording Medium

A recording medium refers to an article to which the liquid composition can attach at least temporarily. A water-absorptive recording medium refers to a recording medium to which pure water transfers in an amount of 0.1 mL/m$^2$ or more within a contact time of 100 ms, when measured by a dynamic scanning liquid absorptiometer. The transfer amount of pure water may be measured by a dynamic scanning liquid absorptiometer (K350 series D type available from Kyowa Co., Ltd.). The transfer amount within a contact time period of 100 ms is determined by interpolating the transfer amounts measured within contact time periods near 100 ms.

Examples of the water-absorptive recording medium include plain paper and commercial printing paper. Here, the commercial printing paper refers to a printing paper having a coated layer on at least one surface of a substrate. The coated layer may comprise a filler such as calcium carbonate and kaolin. More specifically, the coated layer of the commercial printing paper may comprise a white pigment, such as clay (kaolin) and calcium carbonate, and an adhesive (binder) such as starch.

Specific examples of commercially-available plain paper include, but are not limited to, MY PAPER (available from Ricoh Co., Ltd.), XEROX 4200 (available from Fuji Xerox Co., Ltd.), Npi Form NEXT-IJ (available from Nippon Paper Industries Co., Ltd.), npi Premium (available from Nippon Paper Industries Co., Ltd.), and KINBISHI (available from Mitsubishi Paper Mills Limited). Specific examples of commercially-available commercial printing papers include, but are not limited to: POD GLOSS COAT, OK TOP COAT+, OK KINFUJI+, and SA KINFUJI+(available from Oji Paper Co., Ltd.); SUPER MI DULL, AURORA COAT, and SPACE DX (available from Nippon Paper Industries Co., Ltd.); a MATT and μ COAT (available from Hokuetsu Kishu Paper Co., Ltd.); RAICHO ART and RAICHO SUPER ART (available from Chuetsu Pulp & Paper Co., Ltd.), and PEARL COAT N (available from Mitsubishi Paper Mills Limited).

Preferably, the water-absorptive recording medium has a basis weight of from 75 to 190 g/m$^2$. When the basis weight is 75 g/m$^2$ or more, cockling is unlikely to occur and image quality improves. When the basis weight is 190 g/m$^2$ or less, blocking is unlikely to occur and image quality improves.

Image Forming Apparatus

An image forming apparatus according to an embodiment of the present invention includes: a storage storing a liquid composition comprising a pigment, water, a resin, and an organic solvent; a recording medium storage storing a recording medium having water-absorptivity; an applying device configured to apply the liquid composition to the recording medium to form an image thereon; and a winder configured to wind up the recording medium having the image thereon, and the following formulae are satisfied: $1.00\times10^{-3}\leq A\leq 4.00\times10^{-1}$ and $0.010\leq B/A\leq 0.100$, where B (mg/cm$^2$) represents an amount of the organic solvent contained in the image on the recording medium wound up by the winder and A (mg/cm$^2$) represents a total amount of the organic solvent contained in the image and the recording medium wound up by the winder.

An image forming apparatus 1 according to an embodiment of the present invention, illustrated in FIG. 1, forms an image on a recording medium 2 by applying the above-described liquid composition to the recording medium 2. The image forming apparatus 1 includes a sheet feeder 3, a liquid applying device 4, a heater 5, and a winder 6.

The sheet feeder 3 feeds the recording medium 2 to a position to which the liquid applying device 4 applies the liquid composition. In the embodiment illustrated in FIG. 1, a continuous sheet is used as the recording medium 2. The continuous sheet refers to a recording medium that is continuous in a direction of conveyance at image formation and is longer than a print unit (i.e., one page) in the direction of conveyance. The continuous sheet may be a sheet rolled in a roll form ("rolled sheet"). In the embodiment illustrated in FIG. 1, the sheet feeder 3 is a sheet feed roller, and the recording medium 2 rolled in a roll form is set to the sheet feeder 3.

The liquid applying device 4 applies the liquid composition to the recording medium 2 having been fed to form an image thereon. Preferably, the liquid applying device 4 employs an inkjet recording method. In this case, the liquid applying device 4 preferably includes four discharge heads corresponding to black (K), cyan (C), magenta (M), and yellow (Y). Alternatively, the liquid applying device 4 may employ one of blade coating methods, gravure coating methods, bar coating methods, roll coating methods, dip coating methods, curtain coating methods, slide coating methods, die coating methods, and spray coating methods.

The inkjet recording method is a method for discharging the liquid composition by applying a stimulus to the liquid composition. Examples of the stimulus include, but are not limited to, heat (temperature), pressure, vibration, and light. Each of these stimuli can be used alone or in combination with others. Among these, heat and pressure are preferable.

The liquid composition may be discharged by any of the following methods: a piezo method in which a piezoelectric element, serving as a pressure generator for pressurizing the liquid composition in a liquid composition flow channel, deforms a vibration plate that forms a wall surface of the liquid composition flow channel, to vary the inner volume of the liquid composition flow channel to discharge the liquid composition; a thermal method in which a heat element heats the liquid composition in a liquid composition flow channel to generate bubbles; and an electrostatic method in which a vibration plate that forms a wall surface of a liquid composition flow channel and an electrode are disposed facing each other and an electrostatic force generated between the vibration plate and the electrode deforms the vibration plate to vary the inner volume of the liquid composition flow channel to discharge the liquid composition.

Preferably, the liquid composition is discharged as liquid droplets having a volume of from 3 to 40 pL at a discharge injection velocity of from 5 to 20 m/s, a drive frequency of 1 kHz or more, and a resolution of 300 dpi or more.

The discharge head may be equipped with a storage, such as a sub tank, storing the liquid composition. The liquid composition stored in the storage of the discharge head may be supplied from another storage that is serving as a main tank. Examples of the storage serving as a main tank include a casing, such as a cartridge and a bottle, made of a resin, for storing the liquid composition. In the case of cartridge, the liquid composition may be stored in an aluminum pouch equipped with an inner bag made of a resin such as polyethylene.

Referring to FIG. 1, the heater 5 includes a first heater 5-1 and a second heater 5-2. The first heater 5-1 heats one side of the recording medium 2 to which the liquid composition is applied. Examples of the first heater 5-1 include, but are not limited thereto, a heated wind applying device that applies heated wind to the recording medium 2 and an infrared irradiator that irradiates the recording medium 2 with infrared ray. The second heater 5-2 heats the opposite side of the recording medium 2 to which the liquid composition is applied. Examples of the second heater 5-2 include, but are not limited thereto, a heating roller. The heating roller contains a heater disposed at either inside or outside of the roller portion.

The winder 6 winds up the recording medium 2 having been fed by the sheet feeder 3, applied with the liquid composition by the liquid applying device 4, and heated by the heater 5. As the winder 6 winds up the recording medium 2, the recording medium 2 is conveyed in a direction indicated by arrow in FIG. 1.

Referring to FIG. 1, the winder 6 also functions as a pressure applying device that applies a pressure to an image formed on the recording medium 2. In the process that the winder 6 winds up the recording medium 2 on which the image is formed in a roll form, a pressure is applied to the recording medium 2. In particular, in the vicinity of the axis of rotation of the winder 6, a large pressure is applied to the recording medium 2 due to its own weight.

Referring to FIG. 1, in a case in which the winder 6 winds up the recording medium 2 fed from the sheet feeder 3 while applying tension thereto, a pressure is applied to the recording medium 2 even at the outer edge of the winder 6. In this case, the pressure applied to the recording medium 2 can be adjusted by adjusting the tension applied to the recording medium 2. Specifically, the tension applied to the recording medium 2 can be adjusted by adjusting the rotational speed of each of the sheet feeder 3 and the winder 6. In the embodiment illustrated in FIG. 1, a rolled sheet is used as the recording medium, but the recording medium is not limited thereto.

Alternatively, a pressure may be applied to the recording medium on which the image is formed by, for example, stacking the recording medium to apply a weight of the recording medium itself, putting a weight made of a metal, etc. on the recording medium, or applying a pressure using a spring or pump to the recording medium pinched with a jig. The pressure applied to the recording medium may be measured by a surface pressure distribution measuring system (I-SCAN available from Nitta Corporation).

The recording medium may also be a non-rolled sheet such as a continuous sheet which is folded at predetermined intervals or on which stitch perforations are formed at predetermined intervals. In the case of using such a non-rolled sheet as the recording medium, the winder 6 illustrated in FIG. 1 can be omitted, since there is no need to wind it up.

In the case of using such a continuous sheet as the recording medium, the recording medium on which an image is formed can be stacked on one another as being folded along the creases or stitch perforations. In this case, the weight of the stacked recording medium is applied to the image. In such a case in which the weight of the recording medium is applied to the image, a portion in the image forming apparatus where the weight of the recording medium is applied is defined as the pressure applying device. For example, in a case in which a continuous sheet having an image thereon is stacked on an output tray and the weight of the continuous sheet is applied to the image, the output tray serves as the pressure applying device.

In the image forming apparatus according to the present embodiment, not only continuous sheets but also cut sheets can be used as the recording medium. The cut sheet refers to a recording medium that is independent for each print unit (i.e., one page) in a direction of conveyance at image formation. In the case of using cut sheets as the recording media, a pressure can be applied to an image formed on each cut sheet by stacking the cut sheets.

How to measure the pressure applied to the image is described in detail below, in each case in which the pressure is applied by (1) winding up the recording medium, (2) stacking the recording medium to apply the weight of the recording medium, and (3) pressing the recording medium with a pressing roller.

(1) By winding: In a case in which the recording medium is a continuous sheet, and a pressure is applied to the recording medium on which an image is formed by winding up the recording medium in a roll form, the pressure is determined from a value read by a pressure-measuring sensor sheet disposed at a center position of the continuous sheet in a width direction (i.e., rotation axis direction in winding) where the continuous sheet is stacked to have a thickness of 20 cm or more, at the time when the continuous sheet is continuously wound up.

(2) By stacking: In a case in which a pressure is applied to the recording medium on which an image is formed by stacking the recording medium to apply the weight of the recording medium, the pressure is determined from a value read by a pressure-measuring sensor sheet disposed at a center position of the recording medium on which the image is formed, at the time when the recording medium is further stacked thereon to have a thickness of 5 cm or more.

(3) By pressing with a pressing roller: In a case in which a pressure is applied to the recording medium on which an image is formed by pressing the recording medium with a pressing roller, the pressure is determined from a value read by a pressure-measuring sensor sheet disposed at a center position of the recording medium on which the image is formed, at the time when the sensor sheet passes through the pressing roller.

The image forming apparatus according to an embodiment of the present invention may further include a pressure applying device to apply a pressure to an image formed on a recording medium. Examples of the pressure applying device include, but are not limited to, a pair of rollers disposed on upper and lower sides of the recording medium, configured to apply a pressure to the recording medium having an image thereon by conveying the recording medium having an image thereon while sandwiching it.

The image forming apparatus 1 may further include a pretreatment device to perform a pretreatment of a recording medium on which an image has not yet been formed with a pretreatment liquid, and/or an aftertreatment device to perform an aftertreatment of the recording medium on which an image has been formed with an aftertreatment liquid.

The devices disposed in the image forming apparatus 1, such as the liquid applying device 4 and the winder 6, may be independently disposed in separate apparatuses.

The image forming apparatus is not particularly limited so long as it forms an image on a recording medium by discharging the above-described liquid composition and an optional treatment liquid. Specific examples of the image forming apparatus include printer, facsimile machine, multifunction peripheral combining the functions of printer, facsimile machine, and copier, and three-dimensional object forming device.

Image Forming Method

An image forming method according to an embodiment of the present invention may be performed by the image forming apparatus 1, as described in detail below. In this case, the image forming method includes a liquid applying process, a drying process, and a winding process.

Liquid Applying Process

The liquid applying process is a process in which the liquid applying device 4 applies the liquid composition to the recording medium 2 having been fed, to form an image thereon. The image to be formed is not limited to significant ones such as texts and graphics, but includes patterns, such as geometric designs, and three-dimensional images.

Drying Process

The drying process is a process in which the heater 5 heats the recording medium 2 to which the liquid composition is applied, to dry the recording medium 2. The recording medium 2 may be dried by, for example: bringing a heated fluid (e.g., heated wind) into contact with the recording medium to which the liquid composition is applied; bringing a heated object into contact with the recording medium to which the liquid composition is applied to heat the recording medium by heat transfer; or heating the recording medium to which the liquid composition is applied with an energy ray such as infrared ray and far-infrared ray.

In particular, it is preferable that the recording medium to which the liquid composition is applied is dried by applying heated wind to the recording medium or by irradiating the recording medium with infrared ray. Preferably, the heated wind has a temperature of 120° C. or higher, so as to suppress the occurrence of blocking and to improve image quality. The heated wind may be generated from, for example, a heated wind dryer or hot wind generator commercially available. In the present embodiment, for the purpose of preventing the occurrence of cockling and blocking and achieving good balance between image density and gloss, it is preferable that the recording medium is dried in such a manner that a total amount A (mg/cm$^2$) of the organic solvent contained in the recording medium and the image per unit area satisfies the formula $1.00\times10^{-3}\leq A\leq4.00\times10^{-1}$.

Winding Process

The winding process is a process in which the recording medium to which the liquid composition is applied is wound up in a roll form.

The winder winds up the recording medium to which the liquid composition is applied in a roll form.

The winding process is preferably performed by the winder.

Examples of the winder include, but are not limited to, a REWINDING MODULE RW6 (product of HUNKELER AG).

The pressure applied to a rolled continuous sheet may be calculated from diameter, height, and mass of the rolled continuous sheet available from photographs and information thereof.

In a case in which the recording medium is a continuous sheet, it is preferable that the pressure is generated by winding up the continuous sheet to which the liquid composition is applied in a roll form. In the winding process in which the winder winds up the continuous sheet in a roll form, it is preferable that the pressure is applied to the image on the continuous sheet due to tension applied to the continuous sheet when the winder winds up the continuous sheet. The effect of the present invention is achieved as the pressure is applied to the image due to the tension applied to the continuous sheet in the winding process.

A pressure may be applied to the recording medium by a method other than winding up a continuous sheet in a roll form. The method may be either active one or passive one. For example, a pressure may be applied to the recording medium by pressing the recording medium with at least one pressing roller.

The winding process is a process in which the winder 6 winds up the recording medium 2 on which an image is formed, to apply a pressure to the recording medium 2. The method of applying a pressure may be varied depending on the type of image forming apparatus used. In the winding process, preferably, a pressure of from $1.00\times10-^{3}$ to $1.00\times10$ kgf/cm$^2$ or less, more preferably from $5.00\times10^{-1}$ to $1.00\times10$ kgf/cm$^2$, is applied to the recording medium 2. The pressure within this range is preferable for image density and gloss value.

In the winding process, preferably, the recording medium has a temperature of from 30° C. to 60° C. under the pressure. When the temperature of the recording medium is 30° C. or more, cockling is unlikely to occur and image quality improves. When the temperature of the recording medium is 60° C. or less, blocking is unlikely to occur and image quality improves. The temperature of the recording medium may be measured by a contact thermometer such as thermocouple and thermistor, or a non-contact thermometer such as infrared thermometer.

In the winding process, the temperature of the recording medium may be controlled by, for example, adjusting the temperature of the recording medium either previously or at the time when a pressure is applied to the recording medium. Adjusting the temperature of the recording medium previously may be performed by, for example, applying temperature-controlled air to the recording medium, irradiating the recording medium with infrared ray, or bringing the recording medium into contact with a heat roller.

Adjusting the temperature of the recording medium at the time when a pressure is applied to the recording medium may be performed by, for example, adjusting the temperature of a pressure-applying surface of the pressure applying device or storing the pressure applying device along with the recording medium in a temperature-adjustable environment such as a thermostatic chamber.

Organic Solvent Contained in Recording Medium and Image

After the winding process, the following formulae are satisfied: $1.00\times10^{-3}\leq A\leq4.00\times10^{-1}$ and $0.010\leq B/A\leq0.100$, where B (mg/cm$^2$) represents an amount of the organic solvent contained in the image per unit area and A (mg/cm$^2$) represents a total amount of the organic solvent contained in the image and the recording medium per unit area. When the ratio B/A is within the above range, image loss that may be caused due to pressurization does not occur, and it is possible to correct cockling and to form images with high gloss value and image density. It is to be noted that, when calculating the total amount A and the amount B, there is no need to take into consideration any organic solvent accounting for less than 1.00% by mass of the liquid composition.

Figure 2A:
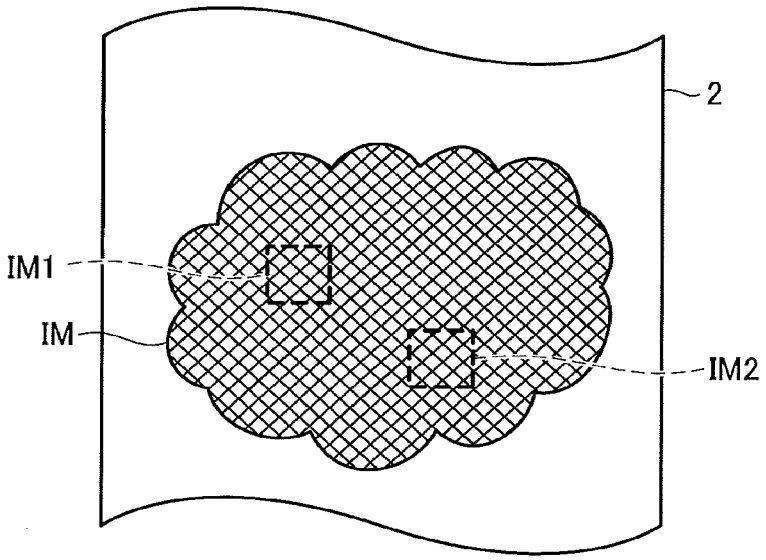
FIGS. 2A and 2B are illustrations of a recording medium on which an image portion is formed.
Figure 2B:
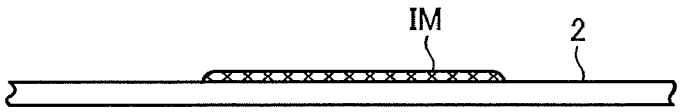

FIG. 2A is an illustration of a recording medium on which an image IM is formed, in a state after the winding process. FIG. 2B is a side view of the recording medium illustrated in FIG. 2A on which the image IM is formed. The image IM is formed of solid contents included in the liquid composition, such as the pigment and the resin. The unit area refers to a 1-cm-square region within the image IM formed on the recording medium 2. The unit area can be set to any position within the image IM, such as a region IM1 and another region IM2, as illustrated in FIG. 2A. In a case in which multiple unit area regions are set in measuring the total amount A and the amount B, it is preferable that all the regions consist of the same pattern, such as solid pattern, equal-density dots, or equal-width stripe.

The total amount A refers to the total amount of the organic solvent permeated the recording medium 2 and that remaining in the image on the surface of the recording medium 2, per unit area of the recording medium 2, measured after a pressure is applied to the recording medium 2 to which the liquid composition is applied. The amount B refers to the amount of the organic solvent remaining in the image on the surface of the recording medium 2 without permeating the recording medium 2, per unit area of the recording medium 2, measured after a pressure is applied to the recording medium 2 to which the liquid composition is applied.

The amount of the organic solvent may be measured by a gas chromatography mass spectrometer (GC-MS). How to measure the total amount A and the amount B is described in detail below.

First, two pieces of recording media each having the same image printed under the same condition are prepared, and the total amount A ($mg/cm^2$) and the amount B ($mg/cm^2$) are measured as follows. Each piece of the recording media is cut into a 1-cm square so as to include the image. The cut piece of the recording medium is dipped in 2.00 g of tetrahydrofuran (special grade reagent, available from Tokyo Chemical Industry Co., Ltd.) contained in 9-ml vial for 12 hours, so that the residual solvent contained in the image and the recording medium is extracted to the tetrahydrofuran. The concentration of the residual solvent contained in the tetrahydrofuran is measured by a GC-MS instrument such as GSMS-TQ8050 and GC-2010 PLUS AF/AOC (available from Shimadzu Corporation).

On the other hand, several tetrahydrofuran solutions of the target organic solvent, each having a predetermined concentration, are prepared, and the concentrations thereof are measured by GC-MS for preparing a calibration curve. A calibration curve is drawn based on the relation between concentration of the organic solvent and peak area of GC spectra. The concentration M ($mg/(g \cdot cm^2)$) of the residual solvent extracted to the tetrahydrofuran is determined with reference to the calibration curve. The total amount A ($mg/cm^2$) is determined from the following formula, based on the above-determined concentration M and the amount of the extraction liquid.

$$M\ (mg/(g \cdot cm^2)) \times 2.00\ (g)$$

Another piece of 1-cm-square recording medium having the image is wiped with a piece of BEMCOT impregnated with tetrahydrofuran. The piece of BEMCOT is thereafter dipped in 4.0 g of tetrahydrofuran (special grade reagent, available from Tokyo Chemical Industry Co., Ltd.) contained in 9-ml vial, so that the residual solvent contained only in the image is extracted to the tetrahydrofuran. The amount B ($mg/cm^2$) is determined in the same manner as the total amount A.

The wiping is performed such that an image density X of the image before being wiped and an image density Y of the image after being wiped satisfy the formula $Y/X \leq 0.10$. The image density is measured by an instrument X-RITE 938 (available from X-Rite Inc.).

The ratio B/A between the total amount A ($mg/cm^2$) of the organic solvent contained in the image and the recording medium per unit area and the amount B ($mg/cm^2$) of the organic solvent contained in the image per unit area can be controlled by adjusting the composition of the liquid composition, the deposition amount of the liquid composition, the temperature of the recording medium under the pressure, the method of drying, the drying temperature, the viscosity of the liquid composition, the rate of increase of the viscosity of the liquid composition, the type of the recording medium, and/or the basis weight of the recording medium. For example, the ratio B/A may be adjusted by adjusting permeability of the liquid composition using a surfactant and/or an organic solvent. The ratio B/A may also be adjusted by increasing or decreasing the deposition amount of the liquid composition. The ratio B/A may also be adjusted by adjusting the rate of increase of the viscosity of the liquid composition when moisture is evaporated. The ratio B/A may also be adjusted by adjusting the drying temperature for drying the recording medium on which the image portion is formed. The ratio B/A may also be adjusted by controlling water-absorptivity of the recording medium by controlling the basis weight thereof.

In a case in which a printing operation is performed without any control, the total amount A ($mg/cm^2$) of the organic solvent contained in the image and the recording medium per unit area becomes $4.20 \times 10^{-1}$, but can be further reduced to satisfy the formula $1.00 \times 10^{-3} \leq A \leq 4.00 \times 10^{-1}$ by increasing the drying temperature and/or the heated wind velocity. However, the ratio B/A remains less than 0.010.

Total Amount of Pigment and Resin Contained in Image per Unit Area

Preferably, a total amount of the pigment and the resin contained in the image per unit area is from 20 to 200 $\mu g/cm^2$. When the total amount is 20 $\mu g/cm^2$ or more, image density increases. When the total amount is 200 $\mu g/cm^2$ or less, cockling is unlikely to occur and image quality improves. The total amount of the pigment and the resin contained in the image per unit area can be adjusted by varying the number of dots in a print chart and/or the amount of the liquid composition discharged from a head.

The total amount of the pigment and the resin contained in the image formed on the recording medium per unit area is measured as follows.

(1) An image formed on a 1-$cm^2$ recording medium is mixed with the below-listed materials and stirred using a juicer mixer METAL LINE TM8100 (available from (Tescom Co., Ltd.) for one minute.

High-purity water at 30° C.: 100 g 3.75 mass % Aqueous solution of sodium hydroxide: 0.2 mL 1.5 mass % Aqueous solution of DI-7020 (available from Kao Corporation): 0.2 mL (2) After being stirred, the liquid is contained in a 300-mL glass beaker, and the air is continuously blown into the liquid at a flow rate of 1.0 L/min for 12 hours by an air pump NON-NOISE S-100 (available from JAPAN PET DESIGN CO., LTD.).

(3) The liquid into which the air has been blown is filtered with a sieve having an opening of 106 μm, and a filtrate is collected.

(4) To the filtrate, 50 mL of 1.0 mol/L hydrochloric acid solution is added, so that calcium carbonate contained in the filtrate is dissolved.

(5) The liquid obtained in (4) is subjected to centrifugal separation under the following conditions, and precipitation (i.e., the resin and pigment derived from the liquid composition) is collected.

Centrifugal separator: CS150GX (available from Hitachi Koki Co., Ltd.)

Angle Rotor: S150AT

Tube: PA Seal tube (Material: polypropylene copolymer)

Number of rotation in centrifugal separation: 150,000 rpm

Time for centrifugal separation: 15 minutes (6) All the precipitation is put in a glass petri dish having a diameter of 12 cm and dried in a constant-temperature dryer DNF301 (available from Yamato Scientific Co., Ltd.) at 120° C. for 12 hours. The amount of the precipitation obtained after the drying comes to the total amount of the pigment and the resin contained in the image portion formed on the recording medium per 1-$cm^2$ area.

Examples

Further understanding can be obtained by reference to certain specific examples which are provided herein for the purpose of illustration only and are not intended to be limiting. Inks prepared in the following examples are embodiments of the above-described liquid composition.

Synthesis of Copolymers

Synthesis of Monomer

In a solution in which 62.0 g (525 mmol) of 1,6-hexanediol (available from Tokyo Chemical Industry Co., Ltd.) was dissolved in 700 mL of methylene chloride, 20.7 g (262 mmol) of pyridine was added. In the resulting solution, another solution in which 50.0 g (262 mmol) of 2-naphthalenecarbonyl chloride (available from Tokyo Chemical Industry Co., Ltd.) was dissolved in 100 mL of methylene chloride was dropped in over a period of 2 hours while stirring the solution, and the resulting liquid was further stirred at room temperature (25° C.) for 6 hours. The resulting liquid was thereafter washed with water and the organic phase was isolated. The isolated organic phase was dried with magnesium sulfate and the solvent was distilled away. The organic phase was further purified by silica gel column chromatography (using a glass column having an inner diameter of 100 mm and a column length of 500 mm and a spherical silica gel 60N (neutral, available from Kanto Chemical Co., Inc.)) using a mixture solvent of methylene chloride/methanol (at a volume ratio of 98/2) as the eluent, thus obtaining 52.5 g of 2-naphthoic acid 2-hydroxyethyl ester.

Next, 42.1 g (155 mmol) of 2-naphthoic acid 2-hydroxyethyl ester was dissolved in 80 mL of dry methyl ethyl ketone and heated to 60° C. In the resulting solution, another solution in which 24.0 g (155 mmol) of 2-methacryloyloxyethyl isocyanate (product name: KARENZ MOI available from Showa Denko K.K.) was dissolved in 20 mL of dry methyl ethyl ketone was dropped over a period of 1 hour while stirring the solution, and the resulting liquid was further stirred at 70° C. for 12 hours. The resulting liquid was thereafter cooled to room temperature and the solvent was distilled away. The liquid was further purified by silica gel column chromatography using a mixture solvent of methylene chloride/methanol (at a volume ratio of 99/1) as the eluent, thus obtaining 57.0 g of a monomer M-1 represented by the following formula (1).

Formula (1)

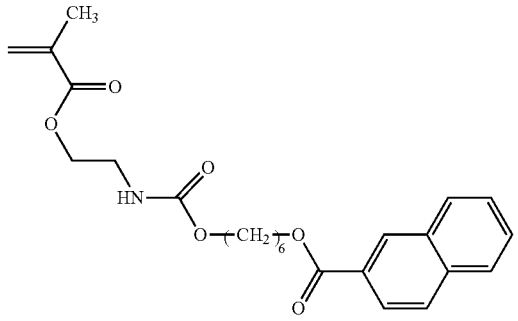

Synthesis of Copolymer R-1

First, 3.80 g (52.7 mmol) of acrylic acid (available from Sigma-Aldrich) and 11.26 g (26.3 mmol) of the monomer M-1 were dissolved in 75 mL of dry methyl ethyl ketone to prepare a monomer solution. Ten percent (10%) by mass of the monomer solution was heated to 75° C. under argon gas flow. In the rest of the monomer solution, a solution of 0.59 g (3.61 mmol) of 2,2'-azoiso(butyronitrile) (available from Tokyo Chemical Industry Co., Ltd.) was dropped over a period of 1.5 hours, and the resulting liquid was stirred at 75° C. for 4 hours. The resulting liquid was cooled to room temperature (25° C.) to obtain a reaction liquid. The reaction liquid was poured in hexane. As a result, copolymer was deposited. The deposited copolymer was filtered and dried under reduced pressures, thus obtaining 14.55 g of a copolymer R-1 (having a weight average molecular weight (Mw) of 30,000).

Next, 5.00 g of the copolymer R-1 (corresponding to 17.5 mmol of carboxyl group) was weighed and stir-mixed with 7.36 g of a 35 mass % aqueous solution of tetraethylammonium hydroxide (available from Tokyo Chemical Industry Co., Ltd., corresponding to 17.5 mmol of tetraethylammonium ion) and 37.64 g of ion-exchange water, thus obtaining a 10 mass % aqueous solution of the copolymer R-1.

Pigment Dispersion Preparation Example 1

Preparation of Carbon Black Dispersion PD-1

In a 10 mass % aqueous solution of 37.5 parts by mass of the copolymer R-1, 30.0 parts by mass of a carbon black (NIPEX 160 available from Evonik Japan Co., Ltd.) and 32.5 parts by mass of ion-exchange water were added and stirred for 12 hours. The resulting liquid was thereafter subjected to circulation dispersion for 1 hour using a disc-type bead mill KDL (available from Shinmaru Enterprises Corporation) at a peripheral speed of 10 m/s. The media of the bead mill were zirconia balls having a diameter of 0.3 mm. After the circulation dispersion, the liquid was filtered with a membrane filter (product name: MINSART available from Sartorius Japan K.K.) having an average pore diameter of 1.2 μM. An amount of ion-exchange water was added thereto so that the pigment concentration became 30% by mass. Thus, a carbon black pigment dispersion PD-1 was prepared.

Pigment Dispersion Preparation Example 2

Preparation of Carbon Black Dispersion PD-2

A self-dispersing pigment dispersion was prepared in the same manner as the Method A (pigment surface modification treatment) described in JP-2012-207202-A.

Next, 20 g of a carbon black (NIPEX 160 available from Evonik Japan Co., Ltd., having a BET specific surface area of 150 $m^2/g$, an average primary particle diameter of 20 nm, a pH of 4.0, and a DBP oil absorption of 620 g/100 g), 20 mmol of a compound represented by the following formula (2), and 200 mL of ion-exchange high-purity water were mixed by a Silverson mixer at a revolution of 6,000 rpm at room temperature. In a case in which the pH of the resulting slurry was higher than 4, 20 mmol of nitric acid was added thereto. Thirty minutes later, sodium nitrite (20 mmol) dissolved in a small amount of ion-exchange high-purity water was gently added to the slurry. The slurry was heated to 60° C. while being stirred and subjected to a reaction for 1 hour. As a result, a modified pigment was produced in which a compound having the following formula (2) was added to the carbon black.

Next, the pH was adjusted to 10 by adding an NaOH aqueous solution, thus obtaining a modified pigment dispersion 30 minutes later. The modified pigment dispersion, containing the pigment bonded to at least one of geminal bisphosphonic acid group and sodium geminal bisphosphonate, was subjected to ultrafiltration using a dialysis membrane and ion-exchange high-purity water and thereafter to ultrasonic dispersion. As a result, a self-dispersing black pigment dispersion PD-2 having a solid pigment content concentration of 30% by mass was obtained. The self-dispersing black pigment has bisphosphonate group as a hydrophilic functional group.

Formula (2)

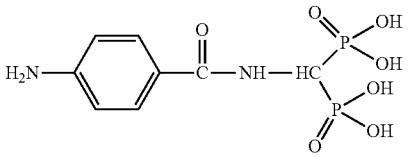

Pigment Dispersion Preparation Example 3

Preparation of Cyan Pigment Dispersion PD-3

The procedure in Pigment Dispersion Preparation Example 1 was repeated except for replacing the carbon black with Pigment Blue 15:3 (product name: CHROMOFINE BLUE available from Dainichiseika Color & Chemicals Mfg. Co., Ltd.). Thus, a cyan pigment dispersion PD-3 having a pigment concentration of 30% by mass was prepared.

Pigment Dispersion Preparation Example 4

Preparation of Magenta Pigment Dispersion PD-4

The procedure in Pigment Dispersion Preparation Example 1 was repeated except for replacing the carbon black with C.I. Pigment Red 122 (product name: TONER MAGENTA E002 available from Clariant Japan KK). Thus, a magenta pigment dispersion PD-4 having a pigment concentration of 30% by mass was prepared.

Pigment Dispersion Preparation Example 5

Preparation of Yellow Pigment Dispersion PD-5

The procedure in Pigment Dispersion Preparation Example 1 was repeated except for replacing the carbon black with C.I. Pigment Yellow 74 (product name: FAST YELLOW 531 available from Dainichiseika Color & Chemicals Mfg. Co., Ltd.). Thus, a yellow pigment dispersion PD-5 having a pigment concentration of 30% by mass was prepared.

Water-Dispersible Resin Dispersion Preparation Example 1

Preparation of Acrylic-Silicone Polymer Particle Dispersion RD-1 Having Tg of 73° C.

After sufficiently replacing the air in a 1-L flask equipped with a mechanical stirrer, a thermometer, a nitrogen gas inlet pipe, a reflux pipe, and a dropping funnel with nitrogen gas, 8.0 g of LATEMUL S-180 (reactive anionic surfactant, available from Kao Corporation) was mixed in 350 g of ion-exchange water in the flask and heated to 65° C. Next, 3.0 g of t-butyl peroxybenzoate (serving as a reaction initiator) and 1.0 g of sodium isoascorbate were added to the flask. Five minutes later, a mixture of 65 g of methyl methacrylate, 135 g of 2-ethylhexyl methacrylate, 5 g of acrylic acid, 45 g of butyl methacrylate, 30 g of cyclohexyl methacrylate, 15 g of vinyl triethoxysilane, 8.0 g of LATEMUL S-180, and 340 g of ion-exchange water was dropped in the flask over a period of 3 hours. The flask contents were aged at 80° C. for 2 hours and thereafter cooled to normal temperature (25° C.). The pH thereof was adjusted to 7 to 8 using sodium hydroxide. Ethanol was removed using an evaporator and the moisture content was controlled. Thus, 730 g of an acrylic-silicone polymer particle dispersion having a solid content concentration of 40% by mass was obtained. The volume average cumulative particle diameter (D50) of the polymer particles in the dispersion was 111 nm when measured by a particle size distribution analyzer (NANOTRAC UPA-EX150 available from Nikkiso Co., Ltd.). The glass transition temperature (Tg) of the resin was 73° C. when measured by a high-sensitivity differential scanning calorimeter THERMO PLUS EVO2 DSC8231 (available from Rigaku Corporation).

Water-Dispersible Resin Dispersion Preparation Example 2

Preparation of Acrylic-Silicone Polymer Particle Dispersion RD-2 Having Tg of 32° C.

The procedure in Water-dispersible Resin Dispersion Preparation Example 1 was repeated except for changing the amount of methyl methacrylate from 65 g to 20 g and the amount of 2-ethylhexyl methacrylate from 135 g to 180 g. Thus, a water-dispersible resin dispersion RD-2 was prepared having a solid content concentration of 40% by mass, a D50 of 120 nm, and a Tg of 32° C.

Water-Dispersible Resin Dispersion Preparation Example 3

Preparation of Acrylic-Silicone Polymer Particle Dispersion RD-3 Having Tg of 50° C.

The procedure in Water-dispersible Resin Dispersion Preparation Example 1 was repeated except for changing the amount of methyl methacrylate from 65 g to 42 g and the amount of 2-ethylhexyl methacrylate from 135 g to 158 g. Thus, a water-dispersible resin dispersion RD-3 was prepared having a solid content concentration of 40% by mass, a D50 of 115 nm, and a Tg of 50° C.

Water-Dispersible Resin Dispersion Preparation Example 4

Preparation of Acrylic-Silicone Polymer Particle Dispersion RD-4 Having Tg of 140° C.

The procedure in Water-dispersible Resin Dispersion Preparation Example 1 was repeated except for changing the amount of methyl methacrylate from 65 g to 81 g and the amount of 2-ethylhexyl methacrylate from 135 g to 119 g. Thus, a water-dispersible resin dispersion RD-4 was prepared having a solid content concentration of 40% by mass, a D50 of 101 nm, and a Tg of 140° C.

Water-Dispersible Resin Dispersion Preparation Example 5

Preparation of Acrylic-Silicone Polymer Particle Dispersion RD-5 Having Tg of 154° C.

The procedure in Water-dispersible Resin Dispersion Preparation Example 1 was repeated except for changing the amount of methyl methacrylate from 65 g to 115 g and the amount of 2-ethylhexyl methacrylate from 135 g to 85 g. Thus, a water-dispersible resin dispersion RD-5 was prepared having a solid content concentration of 40% by mass, a D50 of 124 nm, and a Tg of 154° C.

Black Ink Preparation Example 1

Preparation of Black Ink 1 (IK-1)

In a vessel equipped with a stirrer, 25.0 parts by mass of isopropylene glycol, 5.0 parts by mass of 3-ethyl-3-hydroxymethyloxetane, 1.0 part by mass of glycerin, and 2.0 parts by mass of a silicone-based surfactant 1 (polyether-modified siloxane copolymer, available under the product name TEGO WET 270 from Evonik Japan Co., Ltd.) were stir-mixed for 30 minutes. Next, 20.0 parts by mass of the carbon black pigment dispersion PD-1 and 58.3 parts by mass of ion-exchange water were added thereto and stir-mixed for 60 minutes. Further, 5.0 parts by mass of the acrylic-silicone polymer particle dispersion RD-1 was added thereto and stir-mixed for 30 minutes, thus obtaining a mixture. The mixture was pressure-filtered with a membrane filter (product name: MINSART available from Sartorius Japan K.K.) having an average pore diameter of 1.2 μm, so that coarse particles and foreign substances were removed. Thus, a black ink 1 was prepared.

Black Ink Preparation Examples 2 to 17 (IK-2 to IK-17); Comparative Ink Preparation Examples (RIK-1 to RIK-4); Cyan Ink Preparation Example 1 (IC-1); Magenta Ink Preparation Example 1 (IM-1); and Yellow Ink Preparation Example 1 (IY-1)

Preparation of IK-2 to IK-17, RIK-1 to RIK-4, IC-1, IM-1, and IY-1

The procedure in Black Ink Preparation Example 1 was repeated except for changing the ink composition according to the formulations described in Tables 1 to 4, thus preparing black inks IK-2 to IK-17 and RIK-1 to RIK-4, cyan ink IC-1, magenta ink IM-1, and yellow ink IY-1. In Tables 1 to 4, the unit for blending amounts is "part by mass".

TABLE 1

| | | Examples | | | | | |
|---|---|---|---|---|---|---|---|
| | Materials | IK-1 | IK-2 | IK-3 | IK-4 | IK-5 | IK-6 |
| Pigment | PD-1 Bk Pigment Dispersion | 20.00 | | 10.00 | 20.00 | | |
| | PD-2 Bk Pigment Dispersion | | 20.00 | 10.00 | | 10.00 | 10.00 |
| | PD-3 Cy Pigment Dispersion | | | | | | |
| | PD-4 Ma Pigment Dispersion | | | | | | |
| | PD-5 Ye Pigment Dispersion | | | | | | |
| Resin | Acrylic-silicone Polymer Particle Dispersion RD-1 | 5.00 | 5.00 | | 5.00 | 3.00 | 3.00 |
| | Acrylic -silicone Polymer Particle Dispersion RD-2 | | | | | | |
| | Acrylic -silicone Polymer Particle Dispersion RD-3 | | | | | | |
| | Acrylic -silicone Polymer Particle Dispersion RD-4 | | | | | | |
| | Acrylic -silicone Polymer Particle Dispersion RD-5 | | | | | | |
| | Water-dispersible Urethane Resin Dispersion | | | 5.00 | | | |
| Organic Solvent | Isopropylene Glycol | 25.00 | 5.00 | 1.00 | | 22.00 | 20.00 |
| | 1,2-Propanediol | | | 35.00 | 15.00 | | |
| | 3-Ethyl-3-hydroxymethyloxetane | 5.00 | 5.00 | | 15.00 | | |
| | Glycerin | 1.00 | | | 1.00 | | 2.00 |
| Surfactant | TEGO WET270 | 2.00 | | | 2.00 | 2.00 | 2.00 |
| | SILFACE SAG503A | | 1.00 | | | | |
| Water | Ion-exchange Water | Residual amount | Residual amount | Residual amount | Residual amount | Residual amount | Residual amount |
| | Total | 100.00 | 100.00 | 100.00 | 100.00 | 100.00 | 100.00 |

TABLE 2

| | | Examples | | | | | |
|---|---|---|---|---|---|---|---|
| | Materials | IK-7 | IK-8 | IK-9 | IK-10 | IK-11 | IK-12 |
| Pigment | PD-1 Bk Pigment Dispersion | 30.00 | 30.00 | 5.00 | 5.00 | 30.00 | 30.00 |
| | PD-2 Bk Pigment Dispersion | | | | | | |
| | PD-3 Cy Pigment Dispersion | | | | | | |
| | PD-4 Ma Pigment Dispersion | | | | | | |
| | PD-5 Ye Pigment Dispersion | | | | | | |
| Resin | Acrylic -silicone Polymer Particle Dispersion RD-1 | 7.00 | 7.00 | 2.00 | 2.00 | 4.00 | 4.00 |
| | Acrylic -silicone Polymer Particle Dispersion RD-2 | | | | | | |
| | Acrylic -silicone Polymer Particle Dispersion RD-3 | | | | | | |
| | Acrylic -silicone Polymer Particle Dispersion RD-4 | | | | | | |
| | Acrylic -silicone Polymer Particle Dispersion RD-5 | | | | | | |
| | Water-dispersible Urethane Resin Dispersion | | | | | | |
| Organic Solvent | Isopropylene Glycol | 5.00 | 5.00 | 2.00 | 3.00 | 0.50 | 0.50 |
| | 1,2-Propanediol | | | 12.00 | 15.00 | | |
| | 3-Ethyl-3-hydroxymethyloxetane | 6.00 | 3.00 | | | 10.00 | 11.00 |
| | Glycerin | 7.00 | 10.00 | | | 12.00 | 15.00 |
| Surfactant | TEGO WET270 | 2.00 | 2.00 | 2.00 | 2.00 | 2.00 | 2.00 |
| | SILFACE SAG503A | | | | | | |
| Water | Ion-exchange Water | Residual amount | Residual amount | Residual amount | Residual amount | Residual amount | Residual amount |
| | Total | 100.00 | 100.00 | 100.00 | 100.00 | 100.00 | 100.00 |

TABLE 3

| | Materials | Examples | | | | | |
|---|---|---|---|---|---|---|---|
| | | IK-13 | IK-14 | IK-15 | IK-16 | IK-17 | IC-1 |
| Pigment | PD-1 Bk Pigment Dispersion | 3.00 | 20.00 | 20.00 | 20.00 | 20.00 | |
| | PD-2 Bk Pigment Dispersion | | | | | | |
| | PD-3 Cy Pigment Dispersion | | | | | | 10.00 |
| | PD-4 Ma Pigment Dispersion | | | | | | |
| | PD-5 Ye Pigment Dispersion | | | | | | |
| Resin | Acrylic -silicone Polymer Particle Dispersion RD-1 | 1.00 | | | | | 10.00 |
| | Acrylic -silicone Polymer Particle Dispersion RD-2 | | 5.00 | | | | |
| | Acrylic -silicone Polymer Particle Dispersion RD-3 | | | 5.00 | | | |
| | Acrylic -silicone Polymer Particle Dispersion RD-4 | | | | 5.00 | | |
| | Acrylic -silicone Polymer Particle Dispersion RD-5 | | | | | 5.00 | |
| | Water-dispersible Urethane Resin Dispersion | | | | | | |
| Organic Solvent | Isopropylene Glycol | 20.00 | 25.00 | 25.00 | 25.00 | 25.00 | 2.00 |
| | 1,2-Propanediol | | | | | | |
| | 3-Ethyl-3-hydroxymethyloxetane | | 5.00 | 5.00 | 5.00 | 5.00 | 35.00 |
| | Glycerin | | 1.00 | 1.00 | 1.00 | 1.00 | |
| Surfactant | TEGO WET270 | 2.00 | 2.00 | 2.00 | 2.00 | 2.00 | 1.00 |
| | SILFACE SAG503A | | | | | | |
| Water | Ion-exchange Water | Residual amount | Residual amount | Residual amount | Residual amount | Residual amount | Residual amount |
| | Total | 100.00 | 100.00 | 100.00 | 100.00 | 100.00 | 100.00 |

TABLE 4

| | Materials | Examples | | Comparative Examples | | | |
|---|---|---|---|---|---|---|---|
| | | IM-1 | IY-1 | RIK-1 | RIK-2 | RIK-3 | RIK-4 |
| Pigment | PD-1 Bk Pigment Dispersion | | | 3.00 | | 3.00 | |
| | PD-2 Bk Pigment Dispersion | | | | 30.00 | | 30.00 |
| | PD-3 Cy Pigment Dispersion | | | | | | |
| | PD-4 Ma Pigment Dispersion | 16.67 | | | | | |
| | PD-5 Ye Pigment Dispersion | | 10.00 | | | | |
| Resin | Acrylic -silicone Polymer Particle Dispersion RD-1 | 7.50 | 10.00 | 12.00 | 1.00 | 12.00 | 1.00 |
| | Acrylic -silicone Polymer Particle Dispersion RD-2 | | | | | | |
| | Acrylic -silicone Polymer Particle Dispersion RD-3 | | | | | | |
| | Acrylic -silicone Polymer Particle Dispersion RD-4 | | | | | | |
| | Acrylic -silicone Polymer Particle Dispersion RD-5 | | | | | | |
| | Water-dispersible Urethane Resin Dispersion | | | | | | |
| Organic Solvent | Isopropylene Glycol | 30.00 | 5.00 | 4.00 | 35.00 | 3.00 | 35.00 |
| | 1,2-Propanediol | | 28.00 | | | | |
| | 3-Ethyl-3-hydroxymethyloxetane | | 2.00 | | 5.00 | 5.00 | |
| | Glycerin | | | 2.00 | 5.00 | | 5.00 |
| Surfactant | TEGO WET270 | | 0.50 | 2.00 | | 2.00 | |
| | SILFACE SAG503A | 1.00 | 2.00 | | 1.00 | | |
| Water | Ion-exchange Water | Residual amount | Residual amount | Residual amount | Residual amount | Residual amount | Residual amount |
| | Total | 100.00 | 100.00 | 100.00 | 100.00 | 100.00 | 100.00 |

The product names and manufacturers of the materials described in Tables 1 to 4 are as follows.

Isopropylene glycol: manufactured by Tokyo Chemical Industry Co., Ltd.

1,2-Propanediol: manufactured by Tokyo Chemical Industry Co., Ltd.

3-Ethyl-3-hydroxymethyloxetane: manufactured by Ube Industries, Ltd.

Glycerin: manufactured by Tokyo Chemical Industry Co., Ltd.

Silicone-based surfactant 1: TEGO WET 270 manufactured by Evonik Japan Co., Ltd., polyether-modified siloxane copolymer Silicone-based surfactant 2: SILFACE SAG503A manufactured by Nissin Chemical Industry Co., Ltd., polyether-modified siloxane copolymer Water-dispersible urethane resin dispersion: SUPERFLEX 126 manufactured by DKS Co., Ltd.

Each of the inks was subjected to measurements of a viscosity $\eta 0$ at 25° C. at an initial stage and another viscosity $\eta 1$ at 25° C. when the mass of the ink had reduced to 60% the initial mass. The viscosity was measured with 1.2 mL of each ink using a viscometer (RE-80L available from Toki Sangyo Co., Ltd.). The mass of the ink was reduced to 60% the initial mass by putting 5.0 g of the ink in a glass petri dish having a diameter of 30 mm and leaving it to stand in a thermostatic chamber (desktop thermo-hygrostat chamber LH-114 available from ESPEC CORP.) having a temperature of 50° C. under the atmospheric pressure. The ratio $\eta 1/\eta 0$ was determined from the measured values of $\eta 0$ and $\eta 1$. The results are presented in Table 5.

TABLE 5

| Ink Name | Ink Color | Viscosity of Liquid Composition at 25° C. [mPa · s] | Rate of Increase of Viscosity of Liquid Composition η1/η0 [—] |
|---|---|---|---|
| IK-1 | Bk | 7.5 | 12.3 |
| IK-2 | Bk | 8.0 | 16.0 |
| IK-3 | Bk | 7.0 | 11.1 |
| IK-4 | Bk | 7.7 | 11.9 |
| IK-5 | Bk | 6.9 | 4.5 |
| IK-6 | Bk | 6.8 | 5.2 |
| IK-7 | Bk | 8.9 | 30.3 |
| IK-8 | Bk | 10.0 | 34.0 |
| IK-9 | Bk | 4.9 | 5.3 |
| IK-10 | Bk | 6.0 | 6.7 |
| IK-11 | Bk | 10.0 | 24.4 |
| IK-12 | Bk | 13.0 | 26.9 |
| IK-13 | Bk | 6.2 | 5.1 |
| IK-14 | Bk | 7.3 | 11.1 |
| IK-15 | Bk | 8.2 | 15.0 |
| IK-16 | Bk | 8.0 | 12.1 |
| IK-17 | Bk | 8.9 | 17.8 |
| IC-1 | Cy | 8.7 | 8.0 |
| IM-1 | Ma | 7.5 | 9.6 |
| IY-1 | Ye | 7.9 | 7.8 |
| RIK-1 | Bk | 8.0 | 15.6 |
| RIK-2 | Bk | 9.9 | 13.6 |
| RIK-3 | Bk | 6.8 | 14.6 |
| RIK-4 | Bk | 8.4 | 10.0 |

Preparation of Evaluation Chart

An evaluation chart consisting of a 1-cm-square solid image was prepared with each of the inks. More specifically, an evaluation chart with a recording resolution of 1,200 dpi×1,200 dpi was printed on one surface of a recording medium, at 23° C. and 50 RH, using a piezo recording head which employs a shuttle head method and has a nozzle with an opening diameter of 22 μm and 1,280 nozzles. Here, "dpi" refers to the number of dots within a length of 2.54 cm. Multiple evaluation charts were prepared with each ink, for evaluating the total amount A of residual solvent, the amount B of residual solvent, image density, cockling, blocking resistance (1), and blocking resistance (2). In preparing the evaluation charts, the amount of one droplet of each ink and the number of dots were adjusted so that the total deposition amount of the pigment and the resin contained in the image per unit area became the amount described in Table 6. The type of recording medium used for preparing the evaluation chart is also described in Table 6.

TABLE 6

| | Ink Name | Total Amount of Pigment and Resin in Unit Area [μg/cm$^2$] | Type of Recording Medium | Basis Weight [g/m$^2$] |
|---|---|---|---|---|
| Example 1 | IK-1 | 100 | LUMIART GLOSS | 130 |
| Example 2 | IK-2 | 100 | OK TOP COAT + | 128 |
| Example 3 | IK-3 | 100 | npi Premium | 157 |
| Example 4 | IC-1 | 100 | OK TOP COAT + | 128 |
| Example 5 | IM-1 | 100 | LUMIART GLOSS | 130 |
| Example 6 | IY-1 | 100 | LUMIART GLOSS | 130 |
| Example 7 | IK-4 | 100 | LUMIART GLOSS | 130 |
| Example 8 | IK-1 | 100 | AURORA COAT | 73 |
| Example 9 | IK-1 | 100 | AURORA COAT | 79 |
| Example 10 | IK-1 | 100 | AURORA COAT | 186 |
| Example 11 | IK-1 | 100 | AURORA COAT | 209 |
| Example 12 | IK-5 | 100 | npi Premium | 157 |
| Example 13 | IK-6 | 100 | npi Premium | 157 |
| Example 14 | IK-7 | 100 | npi Premium | 157 |
| Example 15 | IK-8 | 100 | npi Premium | 157 |
| Example 16 | IK-9 | 100 | LUMIART GLOSS | 130 |
| Example 17 | IK-10 | 100 | LUMIART GLOSS | 130 |
| Example 18 | IK-11 | 100 | LUMIART GLOSS | 130 |
| Example 19 | IK-12 | 100 | LUMIART GLOSS | 130 |
| Example 20 | IK-1 | 100 | npi Premium | 157 |
| Example 21 | IK-1 | 100 | npi Premium | 157 |
| Example 22 | IK-1 | 100 | npi Premium | 157 |
| Example 23 | IK-1 | 100 | npi Premium | 157 |
| Example 24 | IK-13 | 100 | npi Premium | 157 |
| Example 25 | IK-1 | 100 | OK TOP COAT + | 85 |
| Example 26 | IK-1 | 100 | OK TOP COAT + | 85 |
| Example 27 | IK-1 | 100 | OK TOP COAT + | 85 |
| Example 28 | IK-1 | 100 | OK TOP COAT + | 85 |
| Example 29 | IK-14 | 100 | LUMIART GLOSS | 130 |
| Example 30 | IK-15 | 100 | LUMIART GLOSS | 130 |
| Example 31 | IK-16 | 100 | LUMIART GLOSS | 130 |
| Example 32 | IK-17 | 100 | LUMIART GLOSS | 130 |
| Example 33 | IK-1 | 9 | LUMIART GLOSS | 90 |
| Example 34 | IK-1 | 20 | LUMIART GLOSS | 90 |
| Example 35 | IK-1 | 200 | LUMIART GLOSS | 90 |
| Example 36 | IK-1 | 350 | LUMIART GLOSS | 90 |
| Example 37 | IK-1 | 100 | LUMIART GLOSS | 130 |
| Example 38 | IK-1 | 100 | LUMIART GLOSS | 130 |
| Comparative Example 1 | RIK-1 | 100 | npi Premium | 157 |
| Comparative Example 2 | RIK-2 | 100 | LUMIART GLOSS | 130 |
| Comparative Example 3 | RIK-3 | 100 | LUMIART GLOSS | 130 |
| Comparative Example 4 | RIK-4 | 100 | OK TOP COAT + | 128 |
| Comparative Example 5 | IK-1 | 100 | LUMIART GLOSS | 130 |
| Comparative Example 6 | IK-1 | 100 | LUMIART GLOSS | 130 |

The following are details of the recording media.

npi Premium (plain paper, available from Nippon Paper Industries Co., Ltd.)

LUMIART GLOSS (coated paper, available from Mondi plc)

OK TOP COAT+ (coated paper, available from Oji Paper Co., Ltd.)

AURORA COAT (coated paper, available from Nippon Paper Industries Co., Ltd.)

Within 5 seconds after completion of printing, heated wind was applied to the recording medium from a dryer for 2 seconds. The velocity and temperature of the heated wind were 20 m/s and 140° C., respectively. After applying heated wind from the dryer, one sheet of unprinted recording medium (the same type as the recording medium having the image portion, 3.0 cm×3.0 cm) was put on the printed portion, and a rubber sheet having a longitudinal length of 3 cm, a lateral length of 3 cm, and a thickness of 0.2 cm was further put thereon. Furthermore, a weight was put on the rubber sheet so that a pressure of 5.00 kgf/cm$^2$ was applied to the evaluation chart from the rubber sheet. The evaluation chart thus pressurized was left to stand at 45° C. and 10% RH for 12 hours. The temperature of the recording medium was measured using a K-type thermocouple (tip-welded, having a wire diameter of 0.2 mm, available from ThreeHigh Co., Ltd.) by bringing the thermocouple into contact with the recording medium, and confirmed to be coincident with the environmental temperature. After the recording medium had been left to stand, the weight, the rubber sheet, and the sheet of unprinted recording medium were removed.

The pressure applied to the image on the recording medium was measured by a surface pressure distribution measuring system I-SCAN (available from Nitta Corporation) and a sensor sheet I-SCAN #5027 (available from Nitta Corporation).

It is to be noted that the same result will be obtained regardless of the pressure applying means so long as the same degree of pressure is applied to the recording medium. For example, even when putting the weight on the recording is replaced with winding the recording medium with a winder, the same result will be obtained.

For each evaluation chart, the total amount A (mg/cm$^2$) of the organic solvent contained in the image and the recording medium per unit area and the amount B (mg/cm$^2$) of the organic solvent contained in the image per unit area were measured as follows.

The recording medium having the image thereon was cut into a 1-cm square so as to include the image. The cut piece of the recording medium was dipped in 2.0 g of tetrahydrofuran (special grade reagent, available from Tokyo Chemical Industry Co., Ltd.) contained in 9-ml vial for 12 hours, so that the residual solvent contained in the image and the recording medium was extracted to the tetrahydrofuran. The concentration of the residual solvent contained in the tetrahydrofuran was measured by a GC-MS instrument GC-2010 PLUS AF/AOC (available from Shimadzu Corporation). The total amount A (mg/cm$^2$) was determined from the quantified concentration and the amount of the extraction liquid.

Another piece of 1-cm-square recording medium having the image was wiped with a piece of BEMCOT impregnated with tetrahydrofuran. The piece of BEMCOT was thereafter dipped in 4.0 g of tetrahydrofuran (special grade reagent, available from Tokyo Chemical Industry Co., Ltd.) contained in 9-ml vial, so that the residual solvent contained only in the image was extracted to the tetrahydrofuran. The concentration of the residual solvent contained in the tetrahydrofuran was measured by a GC-MS instrument GSMS-TQ8050 (available from Shimadzu Corporation). The amount B (mg/cm$^2$) was determined from the quantified concentration and the amount of the extraction liquid.

The wiping was performed such that an image density X of the image portion before being wiped and an image density Y of the image portion after being wiped satisfied the formula $Y/X \leq 0.10$. The image density was measured by an instrument X-RITE 938 (available from X-Rite Inc.). It is to be noted that organic solvents involved in the residual solvent are those accounting for 1.00% by mass or more of the liquid composition.

In addition, the total amount A and the amount B for each evaluation chart were measured under the conditions described in Table 7 in which the type of recording medium, drying method, temperature of heated wind from dryer, pressure applied to the evaluation chart, and/or temperature of recording medium under the pressure were changed. In a case in which the drying is performed by irradiation of infrared ray, within 5 seconds after completion of printing, the evaluation chart is dried by being irradiated with infrared ray emitted from a high-power carbon heater (available from METRO DENKI KOGYO CO., LTD.), the heat source of which has been set to 800° C., from 4 cm above the printed surface for one second. The total amount A, the amount B, and the ratio A/B are described in Table 7. In Table 7, "E±x" refers to "$10^{\pm x}$", and "-" in the column of "Drying method" refers to "no heat drying conducted".

TABLE 7

| | Ink Name | Total Amount A [mg/cm$^2$] | Amount B [mg/cm$^2$] | B/A [—] | Pressure [kgf/cm$^2$] | Temp. of Recording Medium Under Pressure [° C.] |
|---|---|---|---|---|---|---|
| Example 1 | IK-1 | 8.00E−03 | 3.89E−04 | 0.049 | 5.00E+00 | 45 |
| Example 2 | IK-2 | 4.00E−03 | 9.20E−05 | 0.023 | 8.44E+00 | 45 |
| Example 3 | IK-3 | 2.34E−01 | 2.06E−02 | 0.088 | 9.00E−01 | 45 |
| Example 4 | IC-1 | 9.87E−03 | 4.34E−04 | 0.044 | 4.75E+00 | 45 |
| Example 5 | IM-1 | 8.12E−03 | 4.30E−04 | 0.053 | 5.88E+00 | 45 |
| Example 6 | IY-1 | 9.96E−03 | 6.47E−04 | 0.065 | 3.56E+00 | 45 |
| Example 7 | IK-4 | 7.65E−03 | 2.60E−04 | 0.034 | 7.80E+00 | 45 |
| Example 8 | IK-1 | 1.23E−03 | 4.55E−05 | 0.037 | 9.20E−01 | 45 |
| Example 9 | IK-1 | 2.22E−03 | 5.11E−05 | 0.023 | 2.56E+00 | 45 |
| Example 10 | IK-1 | 3.05E−01 | 1.71E−02 | 0.056 | 5.09E+00 | 45 |
| Example 11 | IK-1 | 3.87E−01 | 8.51E−03 | 0.022 | 9.97E+00 | 45 |
| Example 12 | IK-5 | 3.45E−03 | 2.24E−04 | 0.065 | 1.34E+00 | 45 |
| Example 13 | IK-6 | 5.64E−03 | 1.80E−04 | 0.032 | 3.33E+00 | 45 |
| Example 14 | IK-7 | 2.89E−01 | 2.75E−02 | 0.095 | 2.11E+00 | 45 |
| Example 15 | IK-8 | 3.96E−01 | 3.84E−02 | 0.097 | 6.70E−01 | 45 |
| Example 16 | IK-9 | 3.21E−03 | 5.78E−05 | 0.018 | 8.87E+00 | 45 |
| Example 17 | IK-10 | 6.00E−03 | 2.76E−04 | 0.046 | 7.89E+00 | 45 |
| Example 18 | IK-11 | 2.98E−01 | 2.29E−02 | 0.077 | 4.33E+00 | 45 |
| Example 19 | IK-12 | 3.44E−01 | 3.41E−02 | 0.099 | 5.40E−01 | 45 |
| Example 20 | IK-1 | 3.11E−01 | 2.05E−02 | 0.066 | 3.76E+00 | 45 |
| Example 21 | IK-1 | 8.50E−03 | 1.02E−04 | 0.012 | 5.34E+00 | 45 |
| Example 22 | IK-1 | 1.04E−03 | 1.04E−05 | 0.010 | 1.00E+01 | 45 |
| Example 23 | IK-1 | 1.05E−03 | 1.26E−05 | 0.012 | 9.99E+00 | 45 |
| Example 24 | IK-13 | 4.00E−01 | 4.00E−02 | 0.100 | 5.00E−01 | 45 |
| Example 25 | IK-1 | 8.23E−03 | 4.03E−04 | 0.049 | 7.88E+00 | 25 |
| Example 26 | IK-1 | 8.02E−03 | 8.82E−05 | 0.011 | 5.66E+00 | 30 |
| Example 27 | IK-1 | 5.41E−03 | 1.68E−04 | 0.031 | 6.55E+00 | 60 |
| Example 28 | IK-1 | 2.30E−03 | 2.76E−05 | 0.012 | 1.78E+00 | 80 |
| Example 29 | IK-14 | 3.89E−01 | 3.81E−02 | 0.098 | 5.30E−01 | 45 |
| Example 30 | IK-15 | 3.10E−01 | 2.29E−02 | 0.074 | 1.20E+00 | 45 |
| Example 31 | IK-16 | 5.00E−03 | 1.70E−04 | 0.034 | 8.99E+00 | 45 |

TABLE 7-continued

| | | | | | | |
|---|---|---|---|---|---|---|
| Example 32 | IK-17 | 3.23E−03 | 6.46E−05 | 0.020 | 9.89E+00 | 45 |
| Example 33 | IK-1 | 1.01E−03 | 1.21E−05 | 0.012 | 9.90E+00 | 45 |
| Example 34 | IK-1 | 3.33E−03 | 6.66E−05 | 0.020 | 6.77E+00 | 45 |
| Example 35 | IK-1 | 2.88E−01 | 2.22E−02 | 0.077 | 3.43E+00 | 45 |
| Example 36 | IK-1 | 3.98E−01 | 3.94E−02 | 0.099 | 5.30E−01 | 45 |
| Example 37 | IK-1 | 7.89E−03 | 4.10E−04 | 0.052 | 1.03E−03 | 45 |
| Example 38 | IK-1 | 8.12E−03 | 4.14E−04 | 0.051 | 1.00E−03 | 45 |
| Comparative Example 1 | RIK-1 | 8.50E−04 | 4.25E−05 | 0.050 | 5.22E+00 | 45 |
| Comparative Example 2 | RIK-2 | 6.54E−01 | 6.54E−02 | 0.100 | 2.21E+00 | 45 |
| Comparative Example 3 | RIK-3 | 1.01E−03 | 5.05E−06 | 0.005 | 4.00E−01 | 45 |
| Comparative Example 4 | RIK-4 | 4.00E−01 | 6.36E−02 | 0.159 | 9.99E+00 | 45 |
| Comparative Example 5 | IK-1 | 8.21E−03 | 4.11E−04 | 0.050 | 9.80E−04 | 45 |
| Comparative Example 6 | IK-1 | 8.97E−03 | 5.65E−04 | 0.063 | 1.89E+01 | 45 |

| | Drying Method | Temp. of Heated wind [° C.] | Type of Recording Medium | Basis Weight [g/m$^2$] |
|---|---|---|---|---|
| Example 1 | Heated wind | 140 | LUMIART GLOSS | 130 |
| Example 2 | Heated wind | 140 | OK TOP COAT + | 127.9 |
| Example 3 | Heated wind | 140 | npi Premium | 157 |
| Example 4 | Heated wind | 140 | OK TOP COAT + | 127.9 |
| Example 5 | Heated wind | 140 | LUMIART GLOSS | 130 |
| Example 6 | Heated wind | 140 | LUMIART GLOSS | 130 |
| Example 7 | Heated wind | 140 | LUMIART GLOSS | 130 |
| Example 8 | Heated wind | 140 | AURORA COAT | 73.3 |
| Example 9 | Heated wind | 140 | AURORA COAT | 79.1 |
| Example 10 | Heated wind | 140 | AURORA COAT | 186.1 |
| Example 11 | Heated wind | 140 | AURORA COAT | 209 |
| Example 12 | Heated wind | 140 | npi Premium | 157 |
| Example 13 | Heated wind | 140 | npi Premium | 157 |
| Example 14 | Heated wind | 140 | npi Premium | 157 |
| Example 15 | Heated wind | 140 | npi Premium | 157 |
| Example 16 | Heated wind | 140 | LUMIART GLOSS | 130 |
| Example 17 | Heated wind | 140 | LUMIART GLOSS | 130 |
| Example 18 | Heated wind | 140 | LUMIART GLOSS | 130 |
| Example 19 | Heated wind | 140 | LUMIART GLOSS | 130 |
| Example 20 | Heated wind | 100 | npi Premium | 157 |
| Example 21 | Heated wind | 120 | npi Premium | 157 |
| Example 22 | Heated wind | 200 | npi Premium | 157 |
| Example 23 | IR | — | npi Premium | 157 |
| Example 24 | — | — | npi Premium | 157 |
| Example 25 | Heated wind | 140 | OK TOP COAT + | 84.9 |
| Example 26 | Heated wind | 140 | OK TOP COAT + | 84.9 |
| Example 27 | Heated wind | 140 | OK TOP COAT + | 84.9 |
| Example 28 | Heated wind | 140 | OK TOP COAT + | 84.9 |
| Example 29 | Heated wind | 140 | LUMIART GLOSS | 130 |
| Example 30 | Heated wind | 140 | LUMIART GLOSS | 130 |
| Example 31 | Heated wind | 140 | LUMIART GLOSS | 130 |
| Example 32 | Heated wind | 140 | LUMIART GLOSS | 130 |
| Example 33 | Heated wind | 140 | LUMIART GLOSS | 90 |
| Example 34 | Heated wind | 140 | LUMIART GLOSS | 90 |
| Example 35 | Heated wind | 140 | LUMIART GLOSS | 90 |
| Example 36 | Heated wind | 140 | LUMIART GLOSS | 90 |
| Example 37 | Heated wind | 140 | LUMIART GLOSS | 130 |
| Example 38 | Heated wind | 140 | LUMIART GLOSS | 130 |
| Comparative Example 1 | Heated wind | 140 | npi Premium | 157 |
| Comparative Example 2 | — | — | LUMIART GLOSS | 130 |
| Comparative Example 3 | Heated wind | 200 | LUMIART GLOSS | 130 |
| Comparative Example 4 | — | — | OK TOP COAT + | 127.9 |
| Comparative Example 5 | Heated wind | 140 | LUMIART GLOSS | 130 |
| Comparative Example 6 | Heated wind | 140 | LUMIART GLOSS | 130 |

Next, each evaluation chart was subjected to evaluations of "image density", "blocking resistance", and "cockling". The evaluation results are presented in Table 8.

Evaluation of Image Density

An image density of the image of the evaluation chart was measured by an instrument X-RITE 938 (available from X-Rite Inc.) and evaluated based on the following criteria. The image density was measured both immediately after the weight was removed and after the evaluation chart was left at stand at 25° C. and 50% RH for one week.

Plain Paper

Evaluation Criteria for Black Inks

AA: 1.20 or more

A: 1.10 or more and less than 1.20

B: 1.00 or more and less than 1.10

C: less than 1.00

Evaluation Criteria for Cyan Inks

AA: 1.00 or more

A: 0.90 or more and less than 1.00

B: 0.80 or more and less than 0.90

C: less than 0.80

Evaluation Criteria for Magenta Inks

AA: 0.90 or more

A: 0.80 or more and less than 0.90

B: 0.70 or more and less than 0.80

C: less than 0.70

Evaluation Criteria for Yellow Inks

AA: 0.75 or more

A: 0.70 or more and less than 0.75

B: 0.65 or more and less than 0.70

C: less than 0.65

Coated Paper

Evaluation Criteria for Black Inks

AA: 2.00 or more

A: 1.90 or more and less than 2.00

B: 1.80 or more and less than 1.90

C: less than 1.80

Evaluation Criteria for Cyan Inks

AA: 2.00 or more

A: 1.90 or more and less than 2.00

B: 1.80 or more and less than 1.90

C: less than 1.80

Evaluation Criteria for Magenta Inks

AA: 1.90 or more

A: 1.80 or more and less than 1.90

B: 1.70 or more and less than 1.80

C: less than 1.70

Evaluation Criteria for Yellow Inks

AA: 1.00 or more

A: 0.90 or more and less than 1.00

B: 0.80 or more and less than 0.90

C: less than 0.80

Evaluation of Gloss Value

A 60° gloss value of the image of the evaluation chart was measured by a handy gloss meter PC-IIM (available from NIPPON DENSHOKU INDUSTRIES CO., LTD.) and evaluated based on the following criteria.

Plain Paper

AA: 10 or more

A: 7 or more and less than 10

B: 5 or more and less than 7

C: less than 5

Coated Paper

AA: 30 or more

A: 25 or more and less than 30

B: 20 or more and less than 25

C: less than 20

Evaluation of Cockling

The image and the outline portion thereof in the evaluation chart were visually observed to evaluate the degree of cockling based on the following criteria. The degree of cockling was measured under the following three conditions: immediately after the weight was removed; after the evaluation chart was left to stand at 25° C. and 50% RH for one hour; and after the evaluation chart was left to stand at 25° C. and 50% RH for one week.

Evaluation Criteria

AA: No cockling (wrinkle) is observed either in the image or the outline portion thereof.

A: Cockling is very slightly observed in at least one of the image and the outline portion thereof, but there is no problem in practical use.

B: Cockling is very slightly observed in both the image and the outline portion thereof, but there is no problem in practical use.

C: Cockling is clearly observed in the image or the outline portion thereof.

Evaluation of Blocking Resistance (1)

Blocking resistance (1) was evaluated, after the weight, the rubber sheet, and the sheet of unprinted recording medium were removed from above the evaluation chart having been left to stand, by determining:

a) the degree of transfer of the pigment to a surface of the unprinted recording medium which faces the image; and b) the degree of detachment of the pigment in the image, based on the following evaluation criteria.

a) The degree of transfer of the pigment to a surface of the unprinted recording medium which faces the image AA: No pigment transfer is observed.

A: Pigment transfer is very slightly observed (less than 1% of the sheet by area), but there is no problem in practical use.

B: Pigment transfer is slightly observed (1% or more and less than 10% of the sheet by area), but there is no problem in practical use.

C: Pigment transfer is clearly observed (10% or more of the sheet by area).

b) The degree of detachment of the pigment in the image

AA: No pigment detachment is observed in the image.

A: Pigment detachment is very slightly observed in the image (less than 0.5% of the image), but there is no problem in practical use.

B: Pigment detachment is slightly observed in the image (0.5% or more and less than 5% of the image), but there is no problem in practical use.

C: Pigment detachment is clearly observed in the image (5% or more of the image portion).

Blocking Resistance (2)

An evaluation chart for evaluating blocking resistance (2) was prepared in the same manner as the above-prepared evaluation chart for evaluating blocking resistance (1) except for replacing the unprinted recording medium with another sheet of the evaluation chart, such that printed portions of the evaluation charts are superimposed on one another. More specifically, blocking resistance (2) was evaluated, after the weight, the rubber sheet, and one of the superimposed sheets of the evaluation chart were removed, by determining the degree of detachment of the pigment in the image and the degree of sticking of the sheets.

Evaluation Criteria

AA: Almost no pigment detachment is observed in the image. The sheets are not stuck to each other.

A: Almost no pigment detachment is observed in the image, but the sheets are stuck to each other.

B: Pigment detachment is observed in the image (less than 2.0% of the image).

C: Pigment detachment is clearly observed in the image (2.0% or more of the image).

TABLE 8

| | Image Density and Gloss Value | | | | | | | | |
|---|---|---|---|---|---|---|---|---|---|
| | Image Density | | | Cockling | | | Blocking | | |
| | Immediately after | 1 week after | Gloss Value | Immediately after | 1 hour after | 1 week after | Blocking Resistance (1) Transfer | Blocking Resistance (1) Detachment | Blocking Resistance (2) |
| Example 1 | AA | AA | AA | AA | AA | AA | AA | A | AA |
| Example 2 | AA | AA | AA | AA | AA | AA | A | AA | AA |
| Example 3 | AA | AA | AA | AA | AA | AA | A | AA | AA |
| Example 4 | AA | AA | AA | AA | AA | A | AA | AA | AA |
| Example 5 | AA | AA | AA | AA | AA | AA | AA | A | AA |
| Example 6 | AA | AA | AA | AA | AA | A | AA | AA | AA |
| Example 7 | AA | AA | AA | AA | AA | AA | A | A | AA |
| Example 8 | AA | A | AA | B | B | AA | AA | AA | AA |
| Example 9 | AA | A | AA | A | A | AA | AA | AA | AA |
| Example 10 | AA | A | AA | AA | AA | AA | A | A | AA |
| Example 11 | AA | A | AA | AA | AA | AA | B | B | AA |
| Example 12 | A | A | A | A | A | A | AA | A | A |
| Example 13 | AA | A | A | A | A | A | AA | A | A |
| Example 14 | AA | AA | A | A | A | A | A | A | A |
| Example 15 | AA | AA | A | A | A | A | A | B | A |
| Example 16 | A | A | A | B | A | A | AA | A | A |
| Example 17 | A | A | A | A | A | A | AA | A | A |
| Example 18 | AA | A | A | A | A | A | A | A | A |
| Example 19 | A | A | A | A | A | A | B | A | A |
| Example 20 | A | A | A | A | A | A | B | B | A |
| Example 21 | A | A | A | A | A | A | A | A | A |
| Example 22 | AA | AA | AA | AA | AA | AA | AA | AA | AA |
| Example 23 | A | A | A | A | A | A | B | A | A |
| Example 24 | A | A | A | B | A | A | B | B | A |
| Example 25 | A | A | A | B | B | B | A | A | A |
| Example 26 | A | A | A | B | B | A | A | A | A |
| Example 27 | A | A | A | B | A | A | A | A | A |
| Example 28 | A | A | A | B | A | A | A | B | A |
| Example 29 | A | B | A | A | A | A | B | B | B |
| Example 30 | A | A | A | A | A | A | B | B | B |
| Example 31 | A | B | A | B | B | A | A | A | A |
| Example 32 | A | B | A | B | B | B | A | A | A |
| Example 33 | A | B | B | B | B | B | A | A | A |
| Example 34 | A | A | B | B | B | B | A | A | A |
| Example 35 | A | A | A | B | B | A | B | B | B |
| Example 36 | A | A | A | B | B | B | B | B | B |
| Example 37 | A | A | B | B | B | B | B | B | B |
| Example 38 | A | B | B | B | B | B | B | B | B |
| Comparative Example 1 | B | B | B | C | C | C | AA | AA | AA |
| Comparative Example 2 | A | A | A | A | A | A | C | C | C |
| Comparative Example 3 | B | B | B | C | C | C | AA | AA | AA |
| Comparative Example 4 | A | A | A | A | A | A | C | C | C |
| Comparative Example 5 | B | B | A | C | C | C | AA | AA | AA |
| Comparative Example 6 | AA | AA | AA | A | A | A | C | C | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming method comprising:

applying a liquid composition, comprising a pigment, water, a resin, and an organic solvent, to a recording medium having water-absorptivity to form an image thereon; and winding up the recording medium in a roll form after the applying, wherein the following formulae are satisfied:

$$1.00\times10^{-3}\leq A\leq4.00\times10^{-1}$$

$$0.010\leq B/A\leq0.100$$

where B ($mg/cm^2$) represents an amount of the organic solvent contained in the image after the winding and A ($mg/cm^2$) represents a total amount of the organic solvent contained in the image and the recording medium after the winding.

2. The image forming method of claim 1, wherein, in the winding, a pressure of from $1.00\times10^{-3}$ to $1.00\times10$ $kgf/cm^2$ is applied to the recording medium.

3. The image forming method of claim 2, wherein, in the winding, the recording medium has a temperature of from 30° C. to 60° C. under the pressure.

4. The image forming method of claim 1, wherein in the winding, a pressure of from $5.00\times10^{-1}$ to $1.00\times10$ $kgf/cm^2$ is applied to the recording medium.

5. The image forming method of claim 1, wherein a total amount of the pigment and the resin contained in the image per unit area is from 20 to 200 $\mu g/cm^2$.

6. The image forming method of claim 1, wherein the resin has a glass transition temperature of from 50° C. to 140° C.

7. The image forming method of claim 1, further comprising:

drying the recording medium by applying heated wind having a temperature of 120° C. or higher to the recording medium after the applying.

8. The image forming method of claim 1, wherein the liquid composition has a viscosity of from 6.0 to 10.0 mPa·s at 25° C.

9. The image forming method of claim 1, wherein the following formula is satisfied:

$$5.0\leq\eta1/\eta0\leq30.0$$

where $\eta0$ represents a viscosity at 25° C. of the liquid composition; and $\eta1$ represents a viscosity at 25° C. of the liquid composition evaporated under atmospheric pressure at 50° C. until a mass ratio of the liquid composition after evaporation to the liquid composition before evaporation becomes 60%.

10. The image forming method of claim 1, wherein the recording medium has a basis weight of from 75 to 190 $g/m^2$.

11. The image forming method of claim 1, wherein the liquid composition further comprises isopropylene glycol.

12. An image forming method comprising:

(a) applying a liquid composition, comprising a pigment, water, a resin, and an organic solvent, to a recording medium having water-absorptivity to form an image thereon; and (b) applying a pressure of from $1.00\times10^{-3}$ to $1.00\times10$ $kgf/cm^2$ to the recording medium after the step (a), wherein the following formulae are satisfied:

$$1.00\times10^{-3}\leq A\leq4.00\times10^{-1}$$

$$0.010\leq B/A\leq0.100$$

where B ($mg/cm^2$) represents an amount of the organic solvent contained in the image after the step (b) and A ($mg/cm^2$) represents a total amount of the organic solvent contained in the image and the recording medium after the step (b).

13. The image forming method of claim 12, wherein the step (b) further includes winding up the recording medium to apply the pressure thereto.

14. The image forming method of claim 12, wherein the step (b) further includes stacking the recording medium to apply a weight of the recording medium as the pressure thereto.

15. The image forming method of claim 12, wherein the step (b) further includes pressing the recording medium with a pressing roller to apply the pressure thereto.

16. An image forming apparatus comprising:

a storage storing a liquid composition comprising a pigment, water, a resin, and an organic solvent;

a recording medium storage storing a recording medium having water-absorptivity;

an applying device configured to apply the liquid composition to the recording medium to form an image thereon; and a winder configured to wind up the recording medium having the image thereon, wherein the following formulae are satisfied:

$$1.00\times10^{-3}\leq A\leq4.00\times10^{-1}$$

$$0.010\leq B/A\leq0.100$$

where B ($mg/cm^2$) represents an amount of the organic solvent contained in the image on the recording medium wound up by the winder and A ($mg/cm^2$) represents a total amount of the organic solvent contained in the image and the recording medium wound up by the winder.

17. The image forming apparatus of claim 16, wherein the winder is configured to apply a pressure of from $1.00\times10^{-3}$ to $1.00\times10$ $kgf/cm^2$ to the recording medium.

* * * * *